US012366028B2

(12) United States Patent
Woo et al.

(10) Patent No.: US 12,366,028 B2
(45) Date of Patent: Jul. 22, 2025

(54) WASHING MACHINE AND CONTROL METHOD THEREOF

(71) Applicant: Samsung Electronics Co., Ltd., Suwon-si (KR)

(72) Inventors: Jihyun Woo, Suwon-si (KR); Kanghyun Kim, Suwon-si (KR); Jeonghoon Kang, Suwon-si (KR); Hyeoncheol Kim, Suwon-si (KR); Junhyun Park, Suwon-si (KR); Eunsuk Bang, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 744 days.

(21) Appl. No.: 17/570,843

(22) Filed: Jan. 7, 2022

(65) Prior Publication Data

US 2022/0243382 A1 Aug. 4, 2022

(30) Foreign Application Priority Data

Feb. 2, 2021 (KR) ..... 10-2021-0014714

(51) Int. Cl.
*D06F 37/36* (2006.01)
*D06F 34/08* (2020.01)
(Continued)

(52) U.S. Cl.
CPC ..... *D06F 37/36* (2013.01); *D06F 34/08* (2020.02); *D06F 34/18* (2020.02); *D06F 34/20* (2020.02); *D06F 34/22* (2020.02)

(58) Field of Classification Search
CPC ..... D06F 34/18; D06F 2103/06
See application file for complete search history.

(56) References Cited

U.S. PATENT DOCUMENTS 5,241,845 A 9/1993 Ishibashi et al.
5,897,672 A * 4/1999 Badami ..... D06F 34/18 68/12.04
(Continued)

FOREIGN PATENT DOCUMENTS

EP 3 617 369 A1 3/2020
JP H09-239187 A 3/1996
(Continued)

OTHER PUBLICATIONS

International Search Report with Written Opinion dated Apr. 28, 2022; International Appln. No. PCT/KR2022/000383.
(Continued)

*Primary Examiner* — Spencer E. Bell
(74) *Attorney, Agent, or Firm* — Jefferson IP Law, LLP

(57) ABSTRACT

A washing machine is provided that includes a washing tub, a driver to rotate the washing tub, a sensor to sense an operation of the washing machine, and at least one processor configured to obtain a weight of dry fabric of laundry in the washing tub, control the driver to rotate the washing tub at a speed within a first range, and obtain a first torque axis current of the driver. The at least one processor is further configured to, after supplying washing water to the washing tub, control the driver to rotate the washing tub at a speed within a second range and obtain a second torque axis current of the driver, and identify a material of the laundry by inputting at least one of the weight of the dry fabric, the first torque axis current, or the second torque axis current to a neural network model.

14 Claims, 13 Drawing Sheets

(51) Int. Cl.

| | |
|---|---|
| ***D06F 34/18*** | (2020.01) |
| ***D06F 34/20*** | (2020.01) |
| ***D06F 34/22*** | (2020.01) |

(56) References Cited

U.S. PATENT DOCUMENTS

| | | | | |
|---|---|---|---|---|
| 11,203,829 | B2 | 12/2021 | Lee et al. | |
| 2005/0132758 | A1* | 6/2005 | Lee | D06F 39/083 68/23.5 |
| 2010/0263136 | A1* | 10/2010 | Ashrafzadeh | D06F 34/18 68/12.04 |
| 2015/0047128 | A1* | 2/2015 | Goshgarian | D06F 34/18 8/137 |
| 2019/0284743 | A1 | 9/2019 | Hwang et al. | |
| 2019/0390392 | A1 | 12/2019 | Lee et al. | |
| 2020/0011001 | A1* | 1/2020 | Matsui | D06F 39/088 |
| 2020/0018005 | A1* | 1/2020 | Lee | D06F 34/18 |
| 2020/0095719 | A1 | 3/2020 | Im et al. | |
| 2020/0102685 | A1 | 4/2020 | Im et al. | |
| 2020/0109504 | A1 | 4/2020 | Im et al. | |
| 2020/0109506 | A1 | 4/2020 | Im et al. | |

FOREIGN PATENT DOCUMENTS

| | | | |
|---|---|---|---|
| JP | 5508758 | A | 6/2014 |
| JP | 2017-023614 | A | 2/2017 |
| KR | 10-2011-0023061 | A | 3/2011 |
| KR | 10-2013-0044764 | A | 5/2013 |
| KR | 10-1698777 | B1 | 1/2017 |
| KR | 10-2019-0092334 | A | 8/2019 |
| KR | 10-2020-0025554 | A | 3/2020 |
| KR | 10-2020-0026041 | A | 3/2020 |
| KR | 10-2020-0026043 | A | 3/2020 |

OTHER PUBLICATIONS

European Search Report dated Nov. 7, 2023, issued in European Application No. 22749876.3.

* cited by examiner

WASHING MACHINE AND CONTROL METHOD THEREOF

CROSS-REFERENCE TO RELATED APPLICATION(S)

This application is based on and claims priority under 35 U.S.C. § 119(a) of a Korean patent application number 10-2021-0014714, filed on Feb. 2, 2021, in the Korean Intellectual Property Office, the disclosure of which is incorporated by reference herein in its entirety.

BACKGROUND

1. Field

The disclosure relates to a washing machine and a control method thereof. More particularly, the disclosure relates to a washing machine using fabric quality information and a control method thereof.

2. Description of Related Art

Development of electronic technology has enabled development and distribution of various types of electronic devices. Recently, in order to satisfy a user's desire for new and various functions, various types of electronic devices have been developed and distributed.

In a related-art, clothing may be managed and washed using only a washing machine, but these days, clothing may be managed, maintained, dried, or washed using various types of electronic devices such as a clothing manager, a dryer, a dehumidifier, or the like.

A related-art washing machine may perform washing, rinsing, and dehydrating operations for laundry without considering fabric forming the laundry. In this case, there is a problem in that the laundry may be damaged or a user may be less satisfied due to the residual contaminant or residual detergent on the laundry. Even the user wearing the laundry cleaned by using the washing machine can suffer from skin troubles associated with such problems.

Accordingly, there is a need for a washing machine which may automatically recognize a washing course which is optimized to the laundry in consideration of features of fabric forming the laundry, that is, a course to remove contaminants while minimizing damage to laundry, and perform a washing course based thereon, and for this, a washing machine for identifying fabric of laundry (or fabric quality) and a method thereof are required.

The above information is presented as background information only, and to assist with an understanding of the disclosure. No determination has been made, and no assertion is made, as to whether any of the above might be applicable as prior art with regard to the disclosure.

SUMMARY

Aspects of the disclosure are to address at least the above-mentioned problems and/or disadvantages, and to provide at least the advantages described below. Accordingly, an aspect of the disclosure is to provide an electronic device to obtain fabric quality information using a neural network model and a control method thereof.

Additional aspects will be set forth in part in the description which follows and, in part, will be apparent from the description, or may be learned by practice of the presented embodiments.

In accordance with an aspect of the disclosure, a washing machine is provided. The washing machine includes a washing tub, a driver configured to rotate the washing tub, a sensor configured to sense an operation of the washing machine, and at least one processor configured to, based on receiving a user command to operate the washing machine, obtain from the sensor a weight of dry fabric of laundry in the washing tub, control the driver to rotate the washing tub at a speed within a first range, and while the washing tub rotates at the speed within the first range, obtain a first torque axis current of the driver sensed through the sensor. The at least one processor is further configured to, after supplying washing water to the washing tub, control the driver to rotate the washing tub at a speed within a second range, and while the washing tub rotates at the speed within the second range, obtain a second torque axis current of the driver sensed through the sensor, and identify a material of the laundry by inputting at least one of the weight of the dry fabric, the first torque axis current, or the second torque axis current to a neural network model.

In accordance with another aspect of the disclosure, a method of controlling a washing machine including a washing tub is provided. The method includes, based on receiving a user command to operate the washing machine, obtaining a weight of dry fabric of laundry in the washing tub, rotating the washing tub at a speed within a first range, and while the washing tub rotates at the speed within the first range, obtaining a first torque axis current of a driver to rotate the washing tub. The method further includes, after supplying washing water to the washing tub, rotating the washing tub at a speed within a second range, and while the washing tub rotates at the speed within the second range, obtaining a second torque axis current of the driver, and identifying a material of the laundry by inputting at least one of the weight of the dry fabric, the first torque axis current, or the second torque axis current to a neural network model.

In accordance with another aspect of the disclosure, a quality of fabric of laundry may be identified.

In accordance with another aspect of the disclosure, by specifically identifying fabric quality of laundry, a washing course to remove contaminants while minimizing damage to laundry may be performed, increasing satisfaction of a user.

In accordance with another aspect of the disclosure, by identifying fabric quality of laundry, information of the fabric quality may be transmitted to a clothing-related device.

Other aspects, advantages, and salient features of the disclosure will become apparent to those skilled in the art from the following detailed description, which, taken in conjunction with the annexed drawings, discloses various embodiments of the disclosure.

BRIEF DESCRIPTION OF THE DRAWINGS

The above and other aspects, features, and advantages of certain embodiments of the disclosure will be more apparent from the following description taken, in conjunction with the accompanying drawings, in which.

Throughout the drawings, like reference numerals will be understood to refer to like parts, components, and structures.

DETAILED DESCRIPTION

Figure 1:
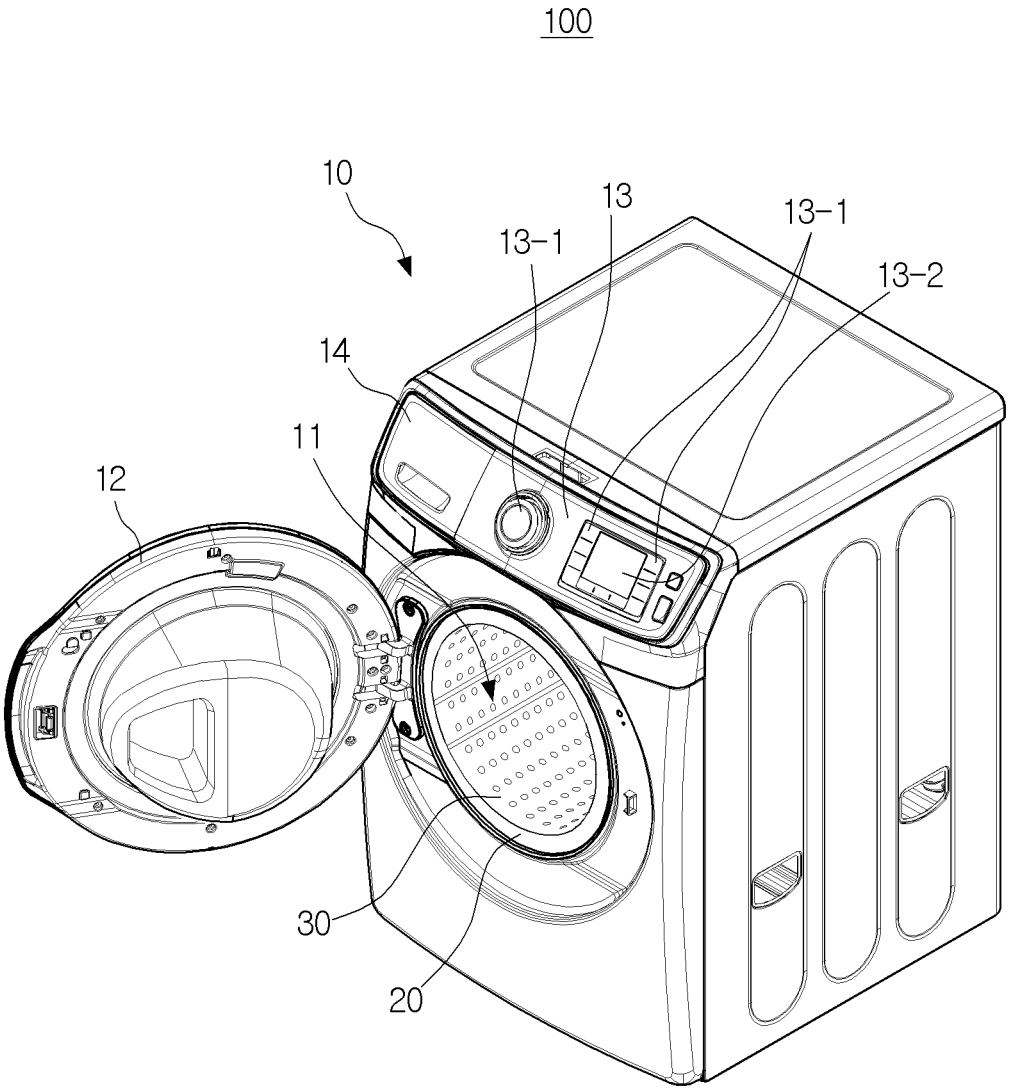
FIG. 1 is a diagram briefly illustrating a washing machine according to an embodiment of the disclosure.

The following description with reference to the accompanying drawings is provided to assist in a comprehensive understanding of various embodiments of the disclosure as defined by the claims and their equivalents. It includes various specific details to assist in that understanding, but these are to be regarded as merely exemplary. Accordingly, those of ordinary skill in the art will recognize that various changes and modifications of the various embodiments described herein can be made without departing from the scope and spirit of the disclosure. In addition, descriptions of well-known functions and constructions may be omitted for clarity and conciseness.

The terms and words used in the following description and claims are not limited to the bibliographical meanings, but are merely used to enable a clear and consistent understanding of the disclosure. Accordingly, it should be apparent those skilled in the art that the following description of various embodiments of the disclosure is provided for illustration purpose only, and not for the purpose of limiting the disclosure as defined by the appended claims and their equivalents.

It is to be understood that the singular forms "a," "an," and "the," include plural referents unless the context clearly dictates otherwise. Thus, for example, reference to "a component surface" includes reference to one or more of such surfaces.

In this disclosure, the expressions "have," "may have," "include," or "may include" or the like, represent presence of a corresponding feature (for example: components such as numbers, functions, operations, or parts) and does not exclude the presence of additional feature.

The expression "At least one of A or/and B" should be understood to represent "A" or "B" or any one of "A and B."

As used herein, the terms "first," "second," or the like, may denote various components, regardless of order and/or importance, and may be used to distinguish one component from another, and does not limit the components.

In addition, the description in the disclosure that one element (e.g., a first element) is "(operatively or communicatively) coupled with/to" or "connected to" another element (e.g., a second element) should be interpreted to include both the case where the one element is directly coupled to the other element, and the case where the one element is coupled to the other element through another intervening element (e.g., a third element).

A singular expression can include a plural expression, unless otherwise specified. It is to be understood that the terms such as "comprise" or "consist of" are used herein to designate a presence of a characteristic, number, operation, element, component, or a combination thereof, and not to preclude a presence or a possibility of adding one or more of other characteristics, numbers, operations, elements, components or a combination thereof.

Terms such as "module," "unit," "part," and so on, may be used to refer to an element that performs at least one function or operation, and such element may be implemented as hardware or software, or a combination of hardware and software. Further, except for when each of a plurality of "modules," "units," "parts," and the like, needs to be realized in individual hardware, the components may be integrated in at least one module or chip and may be realized in at least one processor (not shown).

In this disclosure, a term "user" may refer to a person using an electronic apparatus or an apparatus (for example, artificial intelligence (AI) electronic apparatus) that uses an electronic device.

Hereinafter, various example embodiments of the disclosure will be described in greater detail with reference to the accompanying drawings.

FIG. 1 is a diagram briefly illustrating a washing machine according to an embodiment of the disclosure.

According to an embodiment, a washing machine 100 may refer to a device to wash laundry using water and detergent, and performing dehydration on wet laundry. According to an embodiment, the washing machine 100 may perform drying on the laundry of which the dehydration is completed.

Referring to FIG. 1, the washing machine 100 may include a main body 10, a tub 20, and a washing tub 30.

The main body 10 may form an appearance of the washing machine 100 and a laundry inlet 11 for inserting or taking out laundry into an inside of the main body 10 is provided. A door 12 may be installed at the laundry inlet 11 in an openable or closeable manner.

An input interface 13 may be provided on a front surface of the main body 10 to receive a user command of the washing machine 100. In this example, the input interface 13 may include a plurality of buttons 13-1 for receiving a user command for controlling the washing machine 100 and a display 13-2 for displaying information related to the washing machine 100 and the washing.

The tub 20 may be installed inside the main body 10 of the washing machine 100 and may be formed in a cylindrical shape having an opening toward the laundry inlet 11. The tub 20 may store a predetermined amount of water required for washing.

The washing tub 30 may form a space in which the introduced laundry is washed, and may be formed in a cylindrical shape. The washing tub 30 may be referred to as a drum, but will hereinafter be referred to as the washing tub 30. An opening corresponding to the laundry inlet 11 may be provided on the front surface of the washing tub 30 so that laundry may be introduced into the washing tub 30 through the opening.

The washing tub 30 may include a plurality of through-holes through which water may pass. The water stored in the tub 20 may be introduced into the washing tub 30 through the through-holes, and the water inside the washing tub 30 may be discharged to the tub 20.

The washing tub 30 may be rotated by a driver (not shown) provided in the washing machine 100. When the washing tub 30 is rotated by a driver (not shown), contaminants on the laundry introduced into the washing tub 30 may be removed from the laundry in a process of rubbing with the water stored in the tub 20.

The washing machine 100 may include a water supply device (not shown) for supplying water to the tub 20 (or the washing tub 30). In this example, the water supply device (not shown) may include a water supply pipe (not shown) connected to an external water supply source such as a faucet or the like, and a water supply valve (not shown) for opening and closing the water supply pipe.

The washing machine 100 may also include a detergent receiving portion 14 for supplying a detergent, a fabric softener, or the like, to the tub 20. When water is supplied to the water supply pipe (not shown) by opening the water supply valve (not shown), the water may be supplied to the detergent receiving portion 14, and the detergent, the fabric softener, or the like accommodated in the detergent receiving portion 14 may be mixed with water. Accordingly, the water mixed with the detergent, the fabric softener, or the like, may be supplied to the tub 20.

The washing machine 100 may also include a drain device (not shown) for draining water stored in the tub 20 to the outside. The drain device (not shown) may include a pump (not shown) and a drain pipe (not shown). In this example, the pump (not shown) may discharge the water stored in the tub 20 to the outside of the washing machine 100 through a drain pipe (not shown).

The washing machine 100 may perform a washing operation such as washing, rinsing, and dehydration, thereby removing contaminants from the laundry. The washing machine 100 according to an embodiment may also sense the material and/or material quality (e.g., fabric and/or fabric quality) of the laundry and perform an optimal washing course suitable for the sensed material. The fabric quality may include a fabric (e.g., cotton, linen, wool, silk, synthetic fiber, denim, fur, leather, suede, or the like), and/or a mixture rate (e.g., cotton 70%, acrylic 30%, or the like).

The washing course suitable for laundry may refer to a washing course for removing contaminants in the laundry while minimizing damage to the laundry based on a feature of the material (or fabric and fiber) of the laundry. The washing course may include at least one of a washing course, a rinsing course, or a dehydration course.

The determination related to the washing may include at least one of a washing water supply amount into the washing tub 30, a load of the driver (e.g., a motor) for rotating the washing tub 30, a rotational speed, or a washing time.

Each of the determinations related to the rinsing operation and dehydrating operation may include at least one of a washing water supply amount into the washing tub 30, a load of a driver (e.g., a motor) for rotating the washing tub 30, a rotational speed, and an operation execution time, or the like.

According to various embodiments, the washing machine 100 may detect the fabric quality of the laundry and perform various methods of performing an optimal washing course suitable for the sensed fabric quality.

The fabric quality of the laundry may include the material of the laundry, fabric (e.g., cotton, linen, wool, silk, synthetic fiber, denim, fur, leather, suede, or the like), and/or a mixture rate (e.g., cotton 70%, acrylic 30%, and the like). Hereinafter, for convenience of discussion, the washing machine 100 may divide the fabric quality of laundry into general clothes (for example, clothing made of synthetic fibers of cotton and polyester), delicate clothing (e.g., fabrics made of fibers such as silk, nylon, polyester, polyurethane, and the like), towels, or the like.

The washing machine 100 may divide fabric quality into various types, such as e.g., cotton, linen, wool, silk, synthetic fiber, denim, fur, leather, suede, or the like, and may wash the laundry by performing a washing course corresponding to each type of fabric quality, but embodiments are not limited thereto.

Figure 2:
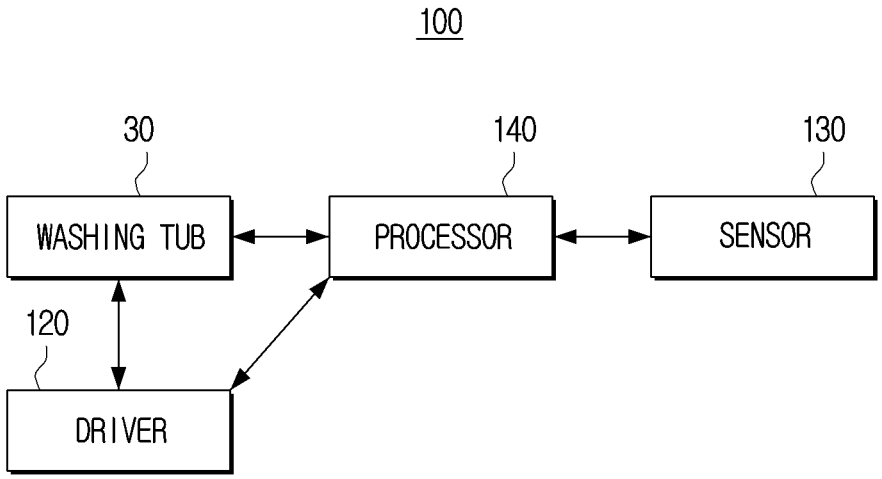
FIG. 2 is a block diagram illustrating a configuration of a washing machine according to an embodiment of the disclosure.

FIG. 2 is a block diagram illustrating a configuration of a washing machine according to an embodiment of the disclosure.

Referring to FIG. 2, the washing machine 100 according to an embodiment includes the washing tub 30, a driver 120, a sensor 130, and at least one processor 140. In addition to the above-described components, the washing machine 100 may include various components, and a duplicate description of the main body 10, the tub 20 and the like described in FIG. 1, will be omitted.

The driver 120 includes at least one driving motor, and rotates the washing tub 30 in which laundry is accommodated, by using the driving motor. The driver 120 may change the current applied to the driving motor to rotate the driving motor, and the driving force generated by the rotation of the driving motor may be transmitted to a pulsator alone or simultaneously to the washing tub 30 and the pulsator. When the control signal generated by the processor 140 is received, the driver 120 may drive the detergent supply unit to supply the detergent included in the detergent supply unit (not shown) to the washing tub 30. When the control signal generated by the processor 140 is received, the driver 120 may drive the water supply unit (not shown) to supply the washing water into the washing tub 30 or drive a drain unit (not shown) to discharge the washing water accommodated in the washing tub 30 to the outside of the washing machine 100. The driving motor included in the driver 120 may be implemented using, for example, one or more of an alternating current (AC) motor or a brushless direct current motor (BLDC) motor.

The sensor 130 according to an embodiment may detect an operation of the washing machine 100.

For example, the sensor 130 may detect a water level of washing water in the washing tub 30. For example, the sensor 130 may detect the water level inside the washing tub 30 using a method of detecting a water level by a machine, a method using a pressure sensor or capacitance measurement method, or the like.

The sensor 130 according to an embodiment may detect a weight of laundry in the washing tub 30. The laundry may include both dry laundry for which hand washing or rough washing has not been performed, or is in a state of not being wet due to washing water, and wet laundry for which hand washing or rough washing is performed or in a wet state by the washing water. Hereinafter, for convenience, dry laundry is referred to as dry fabric, and wet laundry is referred to as wet fabric.

For example, the sensor 130 may detect the weight of the dry fabric inside the washing tub 30, when the washing machine 100 is activated or a washing course is performed according to the user command.

The sensor 130 may detect the water level of the washing water in the washing tub 30 or the weight of the wet fabric, during the washing course.

The sensor 130 may detect the current applied to the driving motor, that is, the torque axis current, while the driving motor (or the washing tub 30) provided in the driver 120 rotates.

For example, when current (i) and voltage (e) are applied to the driving motor, the torque (T) of the driving motor is determined as follows in Equation (1):

$$T = 1/\omega * e * i \qquad \text{Equation 1}$$

Here, ω may refer to the rotational speed of the driving motor, e may refer to voltage, and i may refer to current. As the voltage (e) applied to the driving motor is constant, the torque (T) may be proportional with current (i).

The sensor 130 according to an embodiment may detect the current (i) applied to the driving motor, that is, the torque axis current, and may detect the rotational speed (ω) of the driving motor.

The sensor 130 may detect a temperature in the washing tub 30, a temperature of washing water, or the like.

The processor 140 may control overall operations of the washing machine 100.

The processor 140 may, for example, and without limitation, be implemented with a digital signal processor (DSP), a microprocessor, an artificial intelligence (AI) processor, and a time controller (TCON) which process a digital image signal, but this is not limited thereto. The processor 140 may include, for example, and without limitation, one or more among a central processing unit (CPU), a micro controller unit (MCU), a micro processing unit (MPU), a controller, an application processor (AP), a graphics-processing unit (GPU), a communication processor (CP), an advanced reduced instruction set computing (RISC) machine (ARM) processor, or the like, or may be defined as a corresponding term. The processor 140 may be implemented in a system on chip (SoC) type or a large-scale integration (LSI) type in which a processing algorithm is built therein or in a field programmable gate array (FPGA) type.

The function related to AI may operate through the processor 140 and a memory (not shown). The processor 140 may be configured as one or a plurality of processors, and the processor 140 may be implemented as a general-use processor such as a central processing unit (CPU), an application processor (AP), a digital signal processor (DSP), a graphics-only processor such as a graphic processing unit (GPU), a vision processing unit (VPU), or the like, or an artificial intelligence (AI)-only processor such as a neural processing unit (NPU). One or a plurality of processors may process input data according to a predefined operation rule or an AI model stored in a memory. Alternatively, if one or a plurality of processors is an AI-exclusive processor, the AI-exclusive processor may be designed in a hardware structure specialized in processing of an AI model.

The processor 140 may identify a material of the laundry inside the washing tub 30 through a neural network model and may wash the laundry by identifying and performing a washing course corresponding to the identified material.

A method of identifying the material of the laundry in the washing tub 30 by the processor 140 according to an embodiment will be described with reference to FIG. 3.

Figure 3:
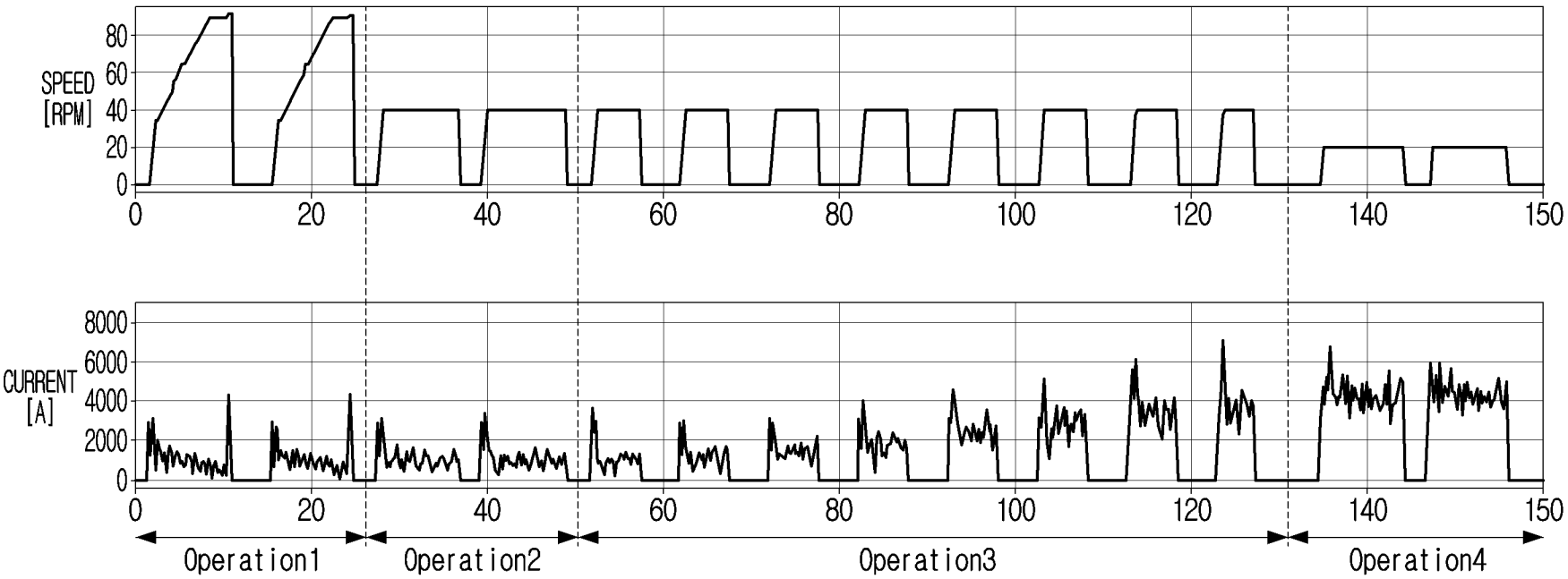
FIG. 3 is a graph illustrating a method of detecting a fabric quality according to an embodiment of the disclosure.

FIG. 3 is a graph illustrating a method of detecting a fabric quality according to an embodiment of the disclosure.

Operation 1

Referring to FIG. 3, the processor 140 according to an embodiment may control the driver 120 to rotate the washing tub 30.

The sensor 130 according to an embodiment may detect the weight of laundry in the washing tub 30 while the washing tub 30 rotates. The weight of the laundry detected by the sensor 130 may refer to a weight of dry fabric, as the laundry is in a state of not being wet.

Referring to operation 1 of FIG. 3, the processor 140 may gradually increase the rotational speed of the washing tub 30 from 0 rpm to 90 rpm over about two times and detect the weight of laundry in the washing tub 30 by using the sensor 130 while the washing tub 30 rotates, but the embodiment is not limited thereto. For example, the processor 140 may rotate the washing tub 30 less than or more than two times, and may rotate the washing tub 30 at various speeds to obtain the weight of laundry in the washing tub 30.

According to Equation 1, the more the weight of the dry fabric, that is, the weight of the laundry, the more the torque axis current in a proportional manner.

Operation 2

The processor 140 may control the driver 120 so that the washing tub 30 rotates at a speed within a first range.

Referring to operation 2 of FIG. 3, the processor 140 may rotate the washing tub 30 at a speed of 30 to 50 rpm. As the washing tub 30 rotates, a process of rising and falling of the laundry within the washing tub 30 may continuously occur.

When the washing tub 30 rotates at a speed in the range of 30 to 50 rpm, the laundry in the non-wet state (i.e., the dry state) is not under inertia, and the laundry may not stick to the wall of the washing tub 30 while the washing tub 30 rotates and may fall. Due to the impact generated during the falling process of the laundry, kinetic energy of the laundry may be lost. The torque axis current applied to the driver 120 by the processor 140 to rotate the washing tub 30 at a speed in a first range (e.g., speed between 30 to 50 rpm) may correspond to lost kinetic energy.

The torque axis current applied to the driver 120 in operation 2 may also be different depending on a material of the laundry.

For example, if the material of the laundry is general clothing or towels, the laundry may form a lump due to features of the material while the washing tub 30 rotates to perform translation and rotation movements, and the kinetic energy of the laundry lost due to the impact generated during the falling process of the laundry may be relatively small. Accordingly, in order to rotate the washing tub 30 at a speed within a first range (e.g., a speed within 30 to 50 rpm), a torque axis current applied to the driver 120 may be relatively small.

As another example, if the material of the laundry is delicate clothing, the laundry may not form one lump due to features of the soft material while the washing tub 30 rotates, and the kinetic energy of the laundry lost due to the impact generated in the falling process of the laundry may be relatively large. Thus, the torque axis current applied to the driver 120 so that the processor 140 rotates the washing tub 30 at a speed within a first range (e.g., a speed within 30 to 50 rpm) may be relatively large.

Figure 4:
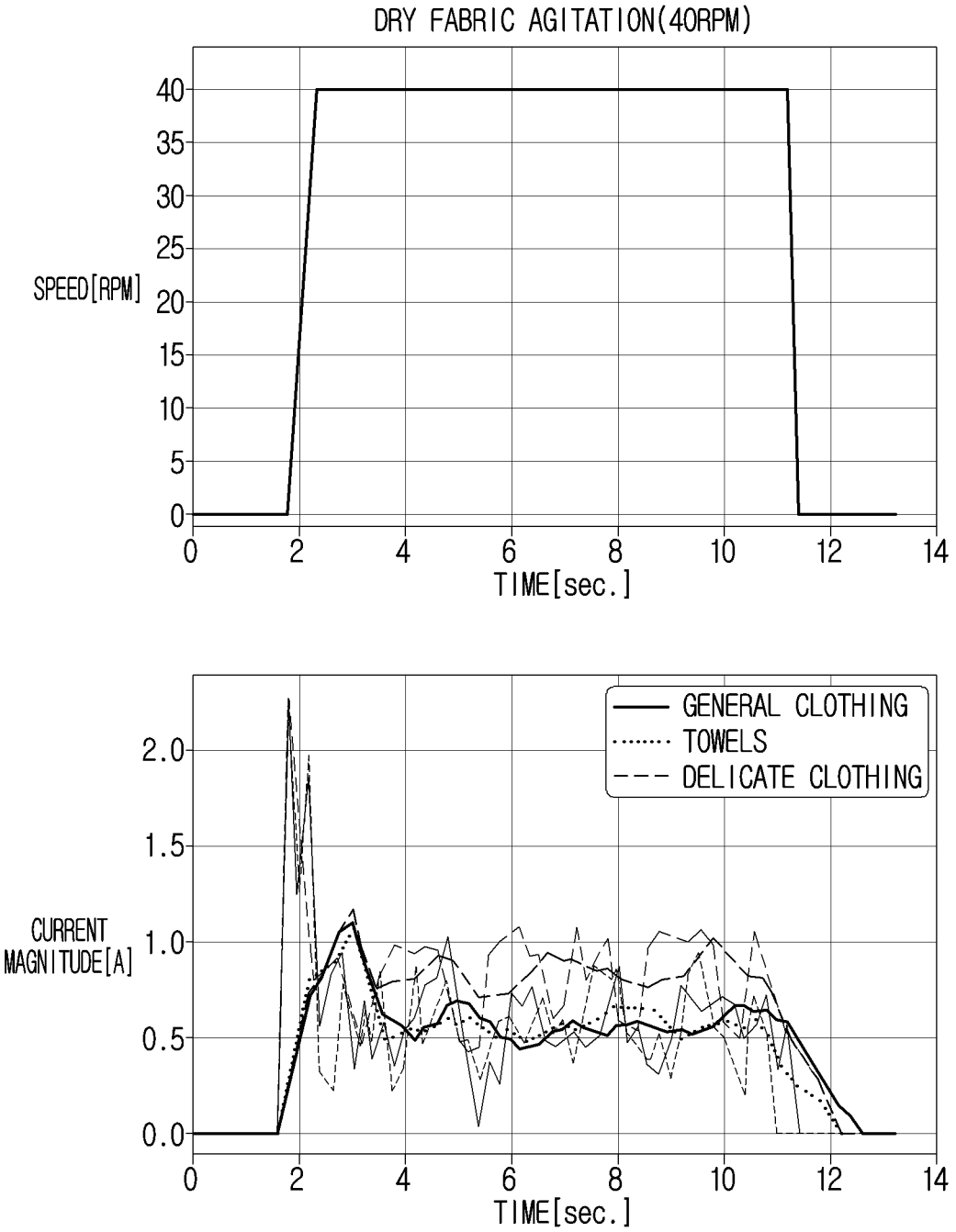
FIG. 4 is a graph illustrating a dry fabric agitation operation according to an embodiment of the disclosure.

A specific description will be provided with regard to FIG. 4.

FIG. 4 is a graph illustrating a dry fabric agitation operation according to an embodiment of the disclosure.

Operation 2 of FIG. 3 refers to an operation of rotating the dry laundry in a non-wet state, that is dry fabric, and may be referred to as the dry fabric agitating operation.

Referring to FIG. 4, the torque axis current detected from the sensor 130 in the dry fabric agitating operation may be different depending on a material of the laundry.

For example, clothes which are relatively large in size or formed of cotton or denim may form one lump while the washing tub 30 rotates at a speed of 40 rpm.

If the washing tub 30 rotates at a speed of about 40 rpm, the laundry may not stick to the wall of the washing tub 30 by centrifugal force, but may fall due to gravity. The clothes composed of a relatively large size, cotton or denim may loss kinetic energy due to impact generated during the falling process, but the amount of lost kinetic energy may be relatively small. Therefore, the torque axis current applied to the driver 120 by the processor 140 to rotate the washing tub 30 at a speed of about 40 rpm may have a relatively smaller torque axis current.

As another example, underwear which is relatively small in size or composed of fiber such as nylon, polyester, polyurethane, or the like, may not form a lump while the wash tub 30 rotates at a speed of about 40 rpm. Accordingly, the underwear composed of fibers such as nylon, polyester, polyurethane, or the like, may lose most of the kinetic energy due to the impact generated during the falling process. In order to rotate the washing tub 30 at a speed of about 40 rpm, the torque axis current applied to the driver 120 by the processor 140 may be relatively large.

For convenience, the torque axis current detected by the sensor 130 in the dry fabric agitating operation (that is, operation 2 of FIG. 3) will be referred to as first torque axis current.

Figure 5:
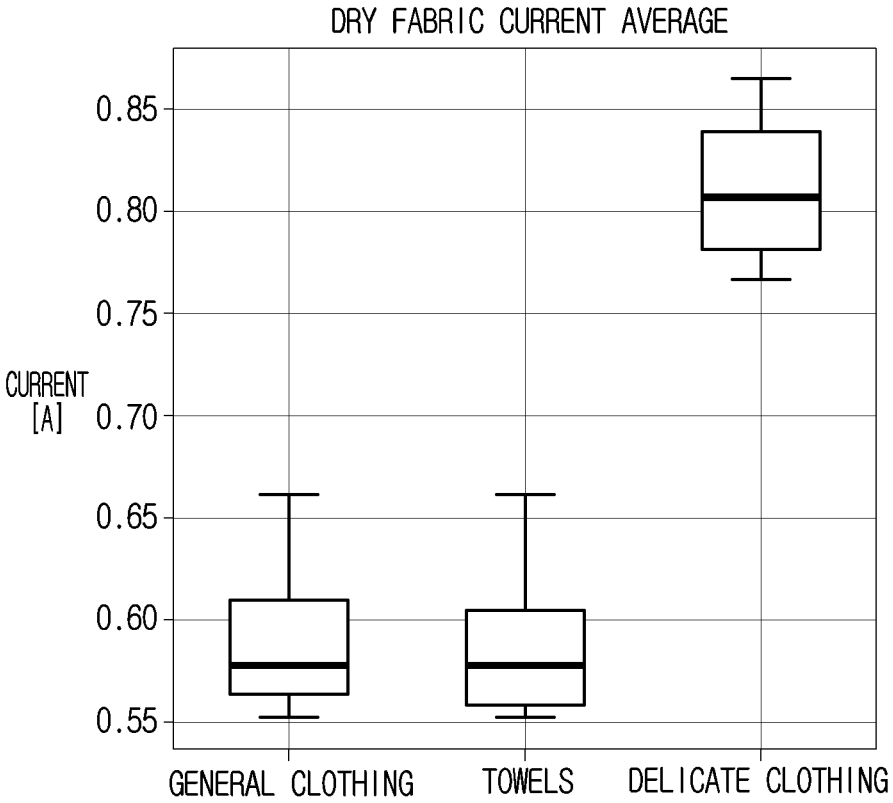
FIG. 5 is a graph illustrating a first torque axis current according to an embodiment of the disclosure.

FIG. 5 is a graph illustrating a first torque axis current according to an embodiment of the disclosure.

Referring to FIG. 5, the processor 140 may obtain a first average current value and a first standard deviation based on the first torque axis current received from the sensor 130.

As described with reference to operation 2 of FIGS. 3 and 4, the clothing which is relatively smaller or composed of fibers such as nylon, polyester, polyurethane, or the like, that is, the delicate clothing, may have the average value of the torque axis current that is relatively larger than the general clothing and the towels in the dry fabric agitating operation.

Returning to FIG. 3, washing water may be provided to the washing tub 30 according to the control of the processor 140.

Operation 3

In operation 1 and operation 2, the laundry in the washing tub 30 is in a non-wet state, that is, the dry fabric state. The processor 140 may supply washing water to the washing tub 30 to change the laundry to web fabric state.

The washing machine 100 according to an embodiment may include a direct water nozzle for spraying washing water directly into the laundry in the washing tub 30. According to the control of the processor 140, the direct water nozzle may spray the washing water into the washing tub 30, and the laundry may be evenly wet so as to change from a dry state to a wet state.

According to an embodiment, only washing water may be supplied to the washing tub 30 in operation 3, and the detergent may not be supplied. Supplying a detergent may cause slip between laundry, and the processor 140 may not accurately identify the material of the laundry. Accordingly, the processor 140, according to an embodiment, may supply only washing water into the washing tub 30 in operation 3, and may not provide the detergent.

The processor 140 may rotate the washing tub 30 so that the laundry may be wet evenly while the washing water is supplied. The operation of controlling the driver 120 by the processor 140 to rotate the washing tub 30 will be referred to as agitating.

Operation 4

The processor 140 may control the driver 120 to rotate the washing tub 30 at a speed in the second range.

Referring to operation 4 of FIG. 3, the processor 140 may rotate the washing tub 30 at a speed of 30 rpm or less. As the washing tub 30 rotates, raising and falling of laundry in the washing tub 30 may continuously occur.

For example, when the washing tub 30 rotates at a speed of 30 rpm or less, laundry in a wet state (i.e., a wet fabric state) may be lifted upward by a lifter in the washing tub 30, and a torque axis current may be generated by gravity. Here, the lifter may be a component disposed inside the washing tub 30 to pull the laundry upward.

According to an embodiment, if the material of the laundry is towels, an absorption rate is relatively higher than another material and this material may be largely affected by gravity.

Accordingly, while the processor 140 rotates the washing tub 30 at a speed within a second range (e.g., a speed of 30 rpm or less), if the laundry in wet state is largely affected by gravity, the torque axis current may be generated relatively largely.

As another embodiment, if the material of the laundry is a delicate cloth, it may be less affected by gravity due to the feature that the absorption rate is relatively lower than another material.

While the processor 140 rotates the washing tub 30 at a speed within a second range (e.g., a speed of 30 rpm or less), if the laundry in a wet state is less affected by gravity, a relatively small amount of torque may be generated.

Details will be described with respect to FIG. 6.

Figure 6:
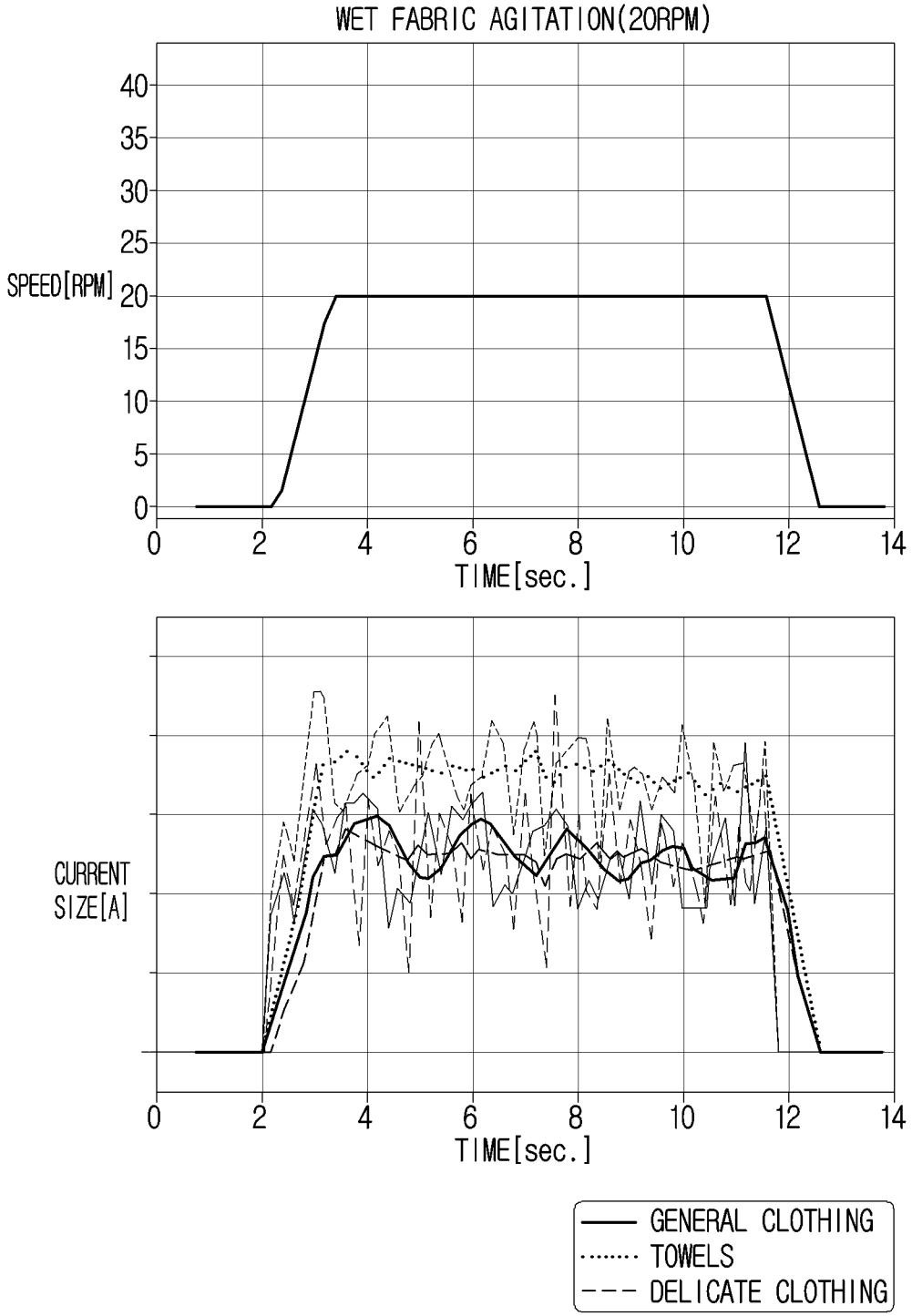
FIG. 6 is a graph illustrating a wet fabric agitation operation according to an embodiment of the disclosure.

FIG. 6 is a graph illustrating a wet fabric agitation operation according to an embodiment of the disclosure.

Operation 4 of FIG. 3 is an operation of rotating laundry in a wet state, that is, rotating a wet fabric, and may be referred to as a wet fabric agitating operation.

Referring to FIG. 6, the torque axis current detected from the sensor 130 in the wet fabric agitating operation may be different according to a material of the laundry.

For example, laundry (for example, towels) composed of materials having a relatively high absorption rate may absorb much of washing water supplied to the washing tub 30 in operation 3 of FIG. 3, and the weight of the laundry (or the weight of wet fabric as compared to dry fabric) will largely increase.

If the washing tub 30 rotates at a speed of about 20 rpm, the laundry may move upward by the lifter in the washing tub 30 and may fall by gravity. Laundry composed of materials having high absorption rate may have relatively large torque due to the influence of gravity.

As another example, laundry composed of materials having a relatively low absorption rate (e.g., underwear composed of fiber such as nylon, polyester, polyurethane, and the like) has a relatively low absorption rate so that the weight of the laundry (or the weight of the web fabric compared to dry fabric) as the washing water supplied to the washing tub 30 is less absorbed in operation 3 of FIG. 3. The laundry composed of materials having low absorption rate is relatively small in torque axis current due to the influence of gravity.

For convenience, the torque axis current detected by the sensor 130 in the wet fabric agitating operation (i.e., operation 4 of FIG. 3) will be referred to a second torque axis current.

Figure 7:
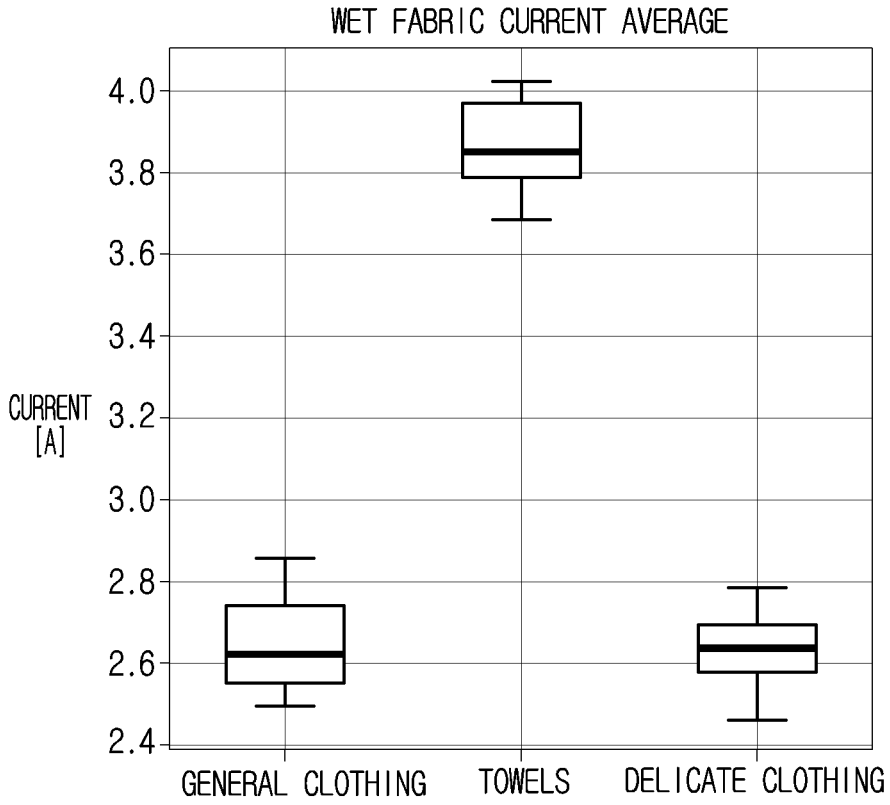
FIG. 7 is a graph illustrating a second torque axis current according to an embodiment of the disclosure.
Figure 8:
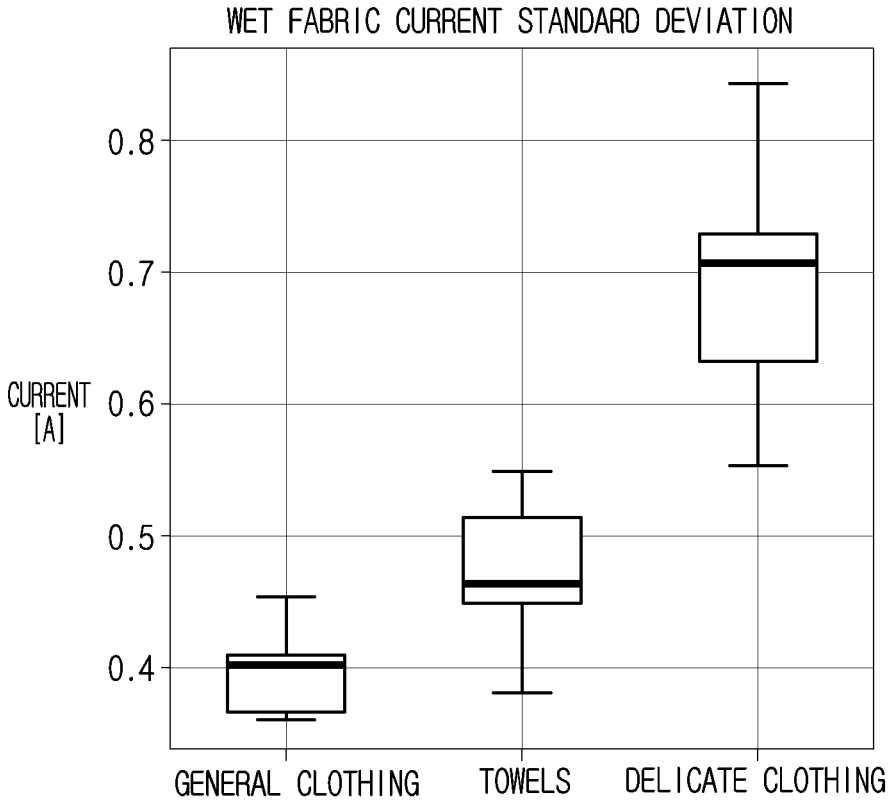
FIG. 8 is a graph illustrating a second torque axis current according to an embodiment of the disclosure.

FIGS. 7 and 8 are graphs illustrating a second torque axis current according to various embodiments of the disclosure.

Referring to FIG. 7, the processor 140 may obtain the second average current value based on the second torque axis current received from the sensor 130.

When the washing tub 30 rotates at a speed within the second range, the movement of the laundry (e.g., rising process and falling process) may not be consecutive, and the processor 140 may obtain the second average current value by performing operation 4 of FIG. 3 for a longer time (e.g., 40 sec or more). However, this is merely an example and is not limited thereto. For example, the processor 140 may perform operation 4 of FIG. 3 within 20 seconds to obtain a second average current value.

Referring to FIG. 8, the processor 140 may obtain the second standard deviation based on the second torque axis current received from the sensor 130.

As described with reference to FIG. 7, when the washing tub 30 rotates at a speed (e.g., 20 rpm or less) within the second range, the movement of the laundry (e.g., the rising and falling operations) may not be consecutive. In particular, in a process where laundry in a wet state lifted by a lifter falls by gravity, a deviation of a torque axis current may be greatly generated.

Referring to the graph of FIG. 8, since the laundry (for example, towels) composed of materials having a relatively high absorption rate has a relatively high weight in a wet fabric state, it may be identified that the deviation of the torque axis current of the laundry is greatly generated when the laundry is lifted by the lifter (rising process) and falls (falling process).

As another embodiment, the absorption rate of general clothing (e.g., cloth composed of composite fiber of cotton and polyester) and delicate clothing (e.g., underwear made of fiber such as silk, nylon, polyester, polyurethane, or the like) is similar, but the second standard deviation obtained based on the second torque axis current may be different.

For example, the general clothing may form one lump since the size is generally large. The general clothing forming one lump may result in less deviation of the torque axis current when lifted by the lifter (rising process) and when falling (falling process) as the general clothing pass the lift as if it rolls.

As another example, the delicate clothing may generally have a feature of small size and soft texture and may not form one lump. When the delicate cloth is lifted up by the lifter (rising process), a deviation of the torque axis current may be greatly generated, as the cloth is attached to a wall of the washing tub 30 and raises to a high angle and then falls (falling process).

Referring again to FIG. 2, the processor 140 according to an embodiment may identify a material and/or material quality (e.g., fabric and/or fabric quality) of the laundry based on the dry fabric weight, first torque axis current, and second torque axis current received from the sensor 130 of operations 1 to 4.

The processor 140 may obtain the first average current value and the first standard deviation based on the first torque axis current received from the sensor 130 at the dry fabric agitating operation as illustrated in FIG. 4.

The processor 140 may obtain the second average current value and the second standard deviation based on the second torque axis current received from the sensor 130 at the wet fabric agitating operation as illustrated in FIG. 6.

The processor 140 may identify the material of the laundry based on the weight of the dry material, the first average current value, the first standard deviation, the second average current value, and the second standard deviation.

As described above with reference to FIGS. 5 and 7-8, the processor 140 may detect the material of the laundry based on the first torque axis current (the first average current value and the first standard deviation) and the second torque axis current (the second average current value and the second standard deviation), since the first torque axis current and the second torque axis current are detected differently in accordance with the feature of the material (e.g., size, level of softness, absorption rate, or the like), as described in FIGS. 5 and 7-8.

For example, as shown in FIG. 5, if the first average current value included in the first torque axis current is greater than or equal to a first threshold value, the processor 140 may identify the material of the laundry as the first material (e.g., delicate clothing).

As shown in FIG. 8, when the second standard deviation included in the second torque axis current is greater than a second threshold value, the processor 140 may identify the material of the laundry as the first material (for example, delicate clothing).

As another example, the processor 140, as illustrated in FIG. 7, may identify the material of the laundry as the second material (e.g., towels), if the second average current value included in the second torque axis current is greater than or equal to a third threshold value.

In another example, the processor 140 may identify the material of the laundry as a third material (e.g., general clothing), if the first average current value included in the first torque current is less than the first threshold value and the second average current value included in the second torque axis current is less than the third threshold value.

In the example described above, the processor 140 is described as identifying the material of laundry in consideration of the first torque axis current and the second torque axis current, respectively, but embodiments are not limited thereto. For example, the processor 140 may identify the material of the laundry by applying different weights to respective dry fabric weight, the first average current value, the first standard deviation, the second average current value, and the second standard deviation, and summing up the values, and may identify the material of the laundry based on the sum value.

It is described that the processor 140 may identify the material of laundry based on at least one of weight of dry fabric, the first torque axis current, or the second torque axis current in a rule-based method, but this is an example and is not limited thereto.

The washing machine 100 may identify the material of the laundry using a neural network model. For example, the processor 140 may identify the material of the laundry by inputting at least one of the weight of the dry fabric, the first average current value, the first standard deviation, the second average current value, or the second standard deviation to the neural network model.

The neural network model may be a model trained to identify the material of the laundry by using the weight of the dry fabric, the average current value of the torque axis current according to the rotation of the washing tub 30, and the standard deviation. As an example, the neural network model may be a model trained using the average current value of the torque axis current and standard deviation which are generated as the washing tub 30 including each of the dry state laundry and the wet state laundry of various materials is rotated, as the ground truth.

That the neural network model and the artificial intelligence model are learned may mean that a basic artificial intelligence model (e.g., an artificial intelligence model including any random parameter) is trained by using a plurality of training data by a learning algorithm, thereby creating a predefined operation rule or artificial intelligence model configured to perform a desired feature (or purpose). The learning may be performed through a separate server and/or a system, but the embodiment is not limited thereto, and may be implemented in the washing machine 100. Examples of learning algorithms include, but are not limited to, supervised learning, unsupervised learning, semi-supervised learning, or reinforcement learning.

Examples of a neural network model 1 may include a convolutional neural network (CNN), a deep neural network (DNN), a recurrent neural network (RNN), a restricted Boltzmann machine (RBM), a deep belief network (DBN), bidirectional recurrent deep neural network (BRDNN), and a deep Q-network, but is not limited thereto.

Figure 9:
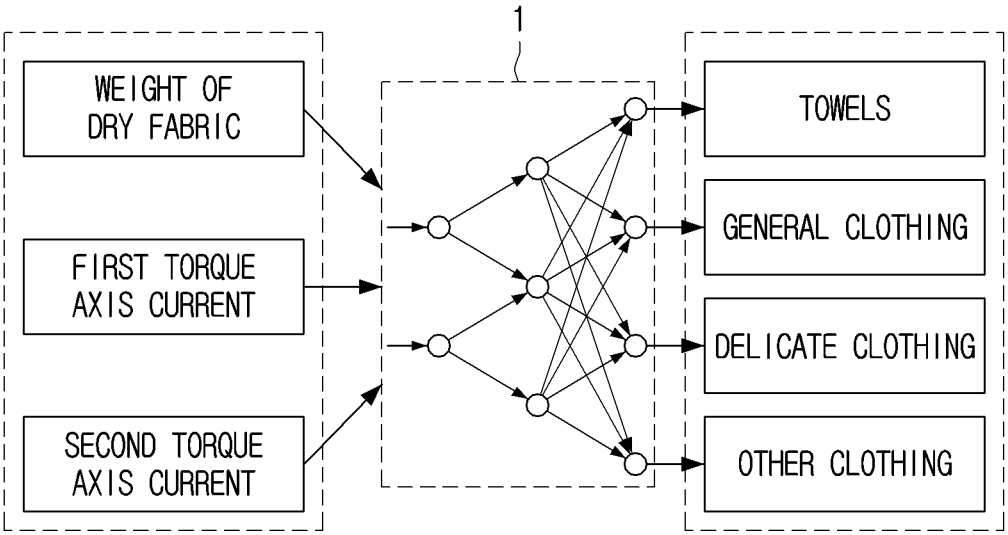
FIG. 9 is a diagram illustrating a neural network model according to an embodiment of the disclosure.

A specific description will be provided with reference to FIG. 9.

FIG. 9 is a diagram illustrating a neural network model according to an embodiment of the disclosure.

The neural network model 1 may output material information of the laundry using at least one of the weight of the dry fabric, the first torque axis current or the second torque axis current.

Referring to FIG. 9, the neural network model 1 may classify the material of laundry using at least one of the weight of the dry fabric, the first torque axis current, or the second torque reduction current. The material information may include cotton, wool, fur, nylon, polyester, polyurethane, leather, denim, or the like. For example, the neural network model 1 may classify the material of the laundry as in Table 1 below.

TABLE 1

| Type of Material | Feature of Material (Absorption Rate) | Examples of Laundry |
|---|---|---|
| Heavy (towels) | High absorption rate | General towel, bath towel, foot mat |
| Normal (general clothing) | Medium absorption rate | Spring and fall shirt, trousers, t-shirt, training clothing |
| Delicate (delicate clothing) | Low absorption rate | Lingerie, chiffon blouse, chiffon one-piece |

However, this is merely an example, and the material information may include a ratio of each of the various materials constituting the laundry when the laundry is made of various materials (or fabric quality, fibers, and the like). The laundry may include a variety of forms composed of fibers such as clothes (e.g., top, bottom, underwear, etc.), towels, curtains, carpet, covers, or the like.

Referring again to FIG. 2, the washing machine 100 according to an embodiment may further include a memory (not shown), and the memory may be implemented as an internal memory such as a read-only memory (ROM) (for example, electrically erasable programmable read-only memory (EEPROM)) and a random-access memory (RANI) or a memory separate from the processor 140. In this case, the memory may be implemented as at least one of a memory embedded within the washing machine 100 or a memory detachable from the washing machine 100 according to the usage of data storage. For example, the data for driving the washing machine 100 may be stored in the memory embedded within the washing machine 100, and the data for upscaling of the washing machine 100 may be stored in the memory detachable from the washing machine 100. A memory embedded in the washing machine 100 may be implemented as at least one of a volatile memory such as a dynamic random access memory (DRAM), a static random access memory (SRAM), a synchronous dynamic random access memory (SDRAM), or a non-volatile memory (for example, one time programmable ROM (OTPROM), programmable ROM (PROM), erasable and programmable ROM (EPROM), electrically erasable and programmable ROM (EEPROM), mask ROM, flash ROM, a flash memory (for example, NAND flash or NOR flash), a hard disk drive (HDD) or a solid state drive (SSD). In the case of a memory detachably mounted to the washing machine 100, the memory may be implemented as a memory card (for example, a compact flash (CF), secure digital (SD), micro secure digital (micro-SD), mini secure digital (mini-SD), extreme digital (xD), multi-media card (MMC), etc.), an external memory (for example, a universal serial bus (USB) memory) connectable to the USB port, or the like.

The memory according to an embodiment may store the neural network model 1. The memory may also store washing course information corresponding to each of the plurality of materials in a database (DB) format or algorithm format.

For example, the DB stored in the memory may include washing course information for washing the laundry suitable for the material (or fabric quality) of the laundry. Here, the meaning of the laundry course information suitable for the material may refer to a washing method or a washing course that may remove the contaminants of the laundry while minimizing damage to the laundry in consideration of the material features of the laundry.

The washing course information corresponding to each of the plurality of materials stored in the memory may have a similar content as in Table 2 below.

TABLE 2

| | Washing course information | | |
|---|---|---|---|
| Type of material | Washing operation | Rinsing operation | Dehydration operation |
| Heavy (towels) | Maintain | Increase in number | Increase in rotational speed (rpm) for performing intermediate dehydration |
| Normal (general clothing) | Maintain | Maintain number | Maintain |
| Delicate (delicate clothing) | Decrease in rotational speed (rpm) by 20% | Increase number | Reduction in rotational speed (rpm) for performing intermediate hydration |

Table 2 above is merely an example and is not limited thereto.

The determination related to the washing operation may include at least one of a washing water supply amount (quantity) into the washing tub 30, a load of a driver (e.g., a motor) for rotating the washing tub 30, a rotational speed, a washing time, or a number of times of the washing operation.

Respective determinations related to the rinsing operation and the dehydration operation may include at least one of the washing water supply amount (quantity) into the washing tub 30, a load of the driver (e.g., a motor) for rotating the washing tub 30, a rotational speed, an operation execution time, or an operation execution number.

For example, the processor 140 may, if the material of the laundry is identified as the delicate cloth (e.g., fabric quality corresponding to delicate), obtain the washing course information corresponding to the delicate cloth.

For example, the operation time of the washing course according to the washing course information corresponding to the delicate clothing may be shorter than the operation time of the normal washing course (e.g., the total time required to perform a washing operation, a rinsing operation, and a dehydration operation). Embodiments are not limited thereto, and the operation time may be the same as or longer than the operation time of a normal washing course.

As another example, the rotational speed of the washing tub (or the degree of load of the driving motor) according to the washing course information corresponding to the delicate clothing may be slower than the rotational speed of the washing tub according to the normal washing course. However, embodiments are not limited thereto, and the rotation speed may be the same as or faster than the rotation speed of the washing tub according to the normal washing course.

As another example, the operation time of the washing course according to the washing course information corresponding to the towels may be longer than the operating time of a normal washing course (e.g., the total time required to perform a washing operation, a rinsing operation, and a dehydration operation). However, embodiments are not limited thereto, and the operating time may be the same as or shorter than the operating time of the normal washing course.

As another example, the rotational speed of the washing tub (or the degree of load of the driving motor) according to the washing course information corresponding to the towels may be faster than the rotational speed of the washing tub according to a normal washing course. However, embodiments are not limited thereto, and the rotation speed may be the same as or shorter than the rotation speed of the washing tub according to the normal washing course.

The related-art washing machine may perform a washing operation, a rinsing operation, or a dehydration operation in consideration of the user's command, the weight of laundry, and the like, without considering the fabric quality of the laundry, the feature of the material of the laundry, or the like. Accordingly, in a case of towels, or the like, with a high absorption rate, there may be a problem in that inflammation to the skin of a user may be caused due to detergent remaining in the laundry and thus, the rinsing operation or the dehydration operation according to a user command needs to be additionally performed.

In an example of underwear, or the like, which is small in size and made of a material easily damaged, there may be a problem in that damage may occur in the washing operation, rinsing operation, or dehydration operation.

According to various embodiments, the processor 140 may perform a dry fabric weight measurement (Operation 1 of FIG. 3), a first torque axis current measurement (Operation 2 of FIG. 3), and a second torque axis current measurement (Operation 4 of FIG. 3) at the stage prior to the rinsing operation, and then may identify the material of the laundry using the measured parameter. The processor 140 may effectively remove contaminants while minimizing damage to the laundry by performing a washing course suitable for the identified material.

The processor 140 according to another embodiment may perform a washing course based on a normal washing course if the weight of the laundry is less than a threshold weight based on the weight of the dry fabric received from the sensor 130. For example, if the weight of the dry fabric is less than 1.5 kg, the processor 140 may perform a washing course based on the normal washing course. Here, the specific number is merely an example and is not limited thereto.

The washing machine 100 may include a communicator (not shown), and may transmit or receive various data with an external device using the communicator. For example, the communicator may receive various data from an external device (for example, a cloth-related device), an external storage medium (for example, a universal serial bus (USB) device), an external server (for example, a web server, ant he like) through communication methods such as an access point (AP)-based Wi-Fi (wireless LAN network), Bluetooth, Zigbee, wired/wireless local area network (LAN), wide area network (WAN), Ethernet, IEEE 1394, high definition multimedia interface (HDMI), universal serial bus (USB), mobile high-definition link (MHL), advanced encryption standard (AES)/European broadcasting union (EBU), optical, coaxial, or the like.

Figure 10:
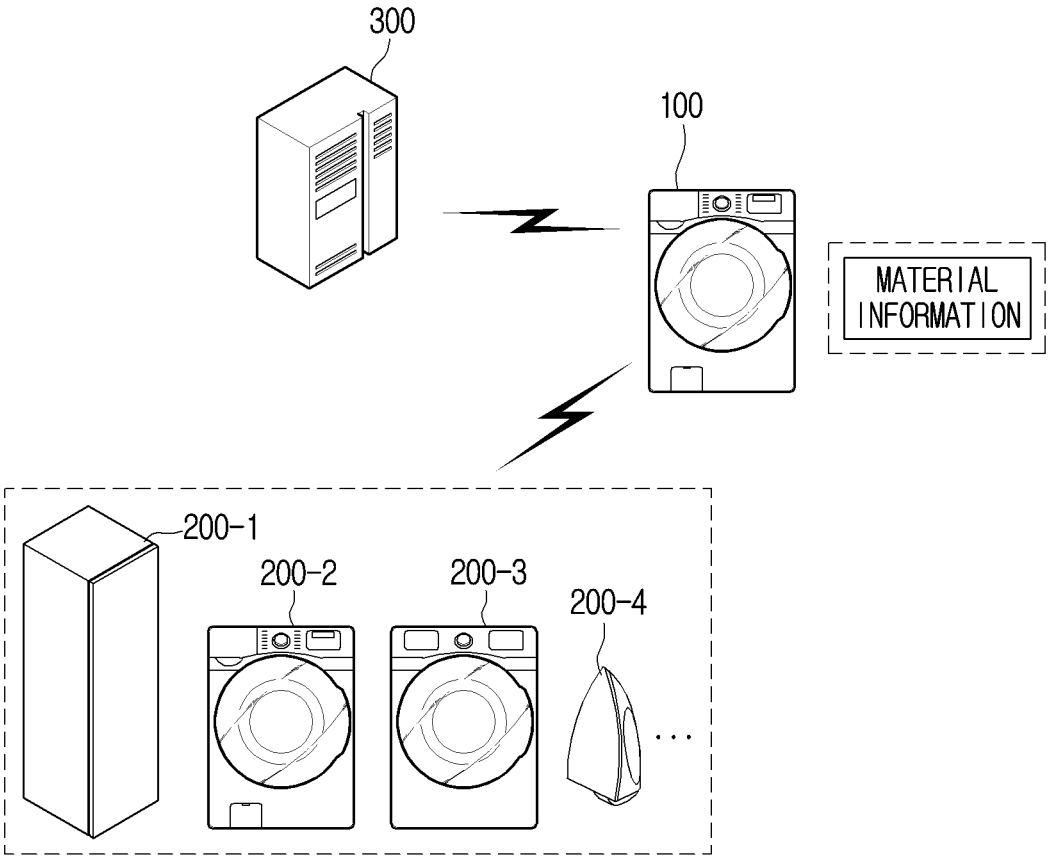
FIG. 10 is a diagram illustrating a washing machine and an external device according to an embodiment of the disclosure.

FIG. 10 is a diagram illustrating a washing machine and an external device according to an embodiment of the disclosure.

Referring to FIG. 10, the processor 140 of the washing machine 100 may identify the material of the laundry and then may transmit the identified material to a clothing-related device (e.g., a clothing manager 200-1, a washing machine 200-2, a clothes dryer 200-3, an electronic iron 200-4, and the like) and/or an external server 300.

As another example, the processor 140 may transmit the weight of the dry fabric of the laundry, the first torque axis current, and the second torque axis current to the external server 300, and may receive, from the external server 300, the material information of the laundry and the washing course information corresponding to the material.

Referring again to FIGS. 1-2, the washing machine 100 may include the display 13-2. The display may be implemented as a display of various types such as, for example, and without limitation, a liquid crystal display (LCD), organic light emitting diodes (OLED) display, liquid crystal on silicon (LCoS), digital light processing (DLP), quantum dot (QD) display panel, quantum dot light-emitting diodes (QLED), μLED (Micro light-emitting diodes), Mini LED, or the like. The display may be implemented as a touch screen coupled to a touch sensor, a flexible display, a rollable display, a third-dimensional (3D) display, a display in which a plurality of display modules are physically connected, or the like.

The processor 140 according to an embodiment may control the display to display the material of the laundry obtained through the neural network model 1 and information (e.g., a progress rate, a remaining time, or the like) about the operation (e.g., washing operation, rinsing operation, or dehydration operation) which is being performed.

Figure 11:
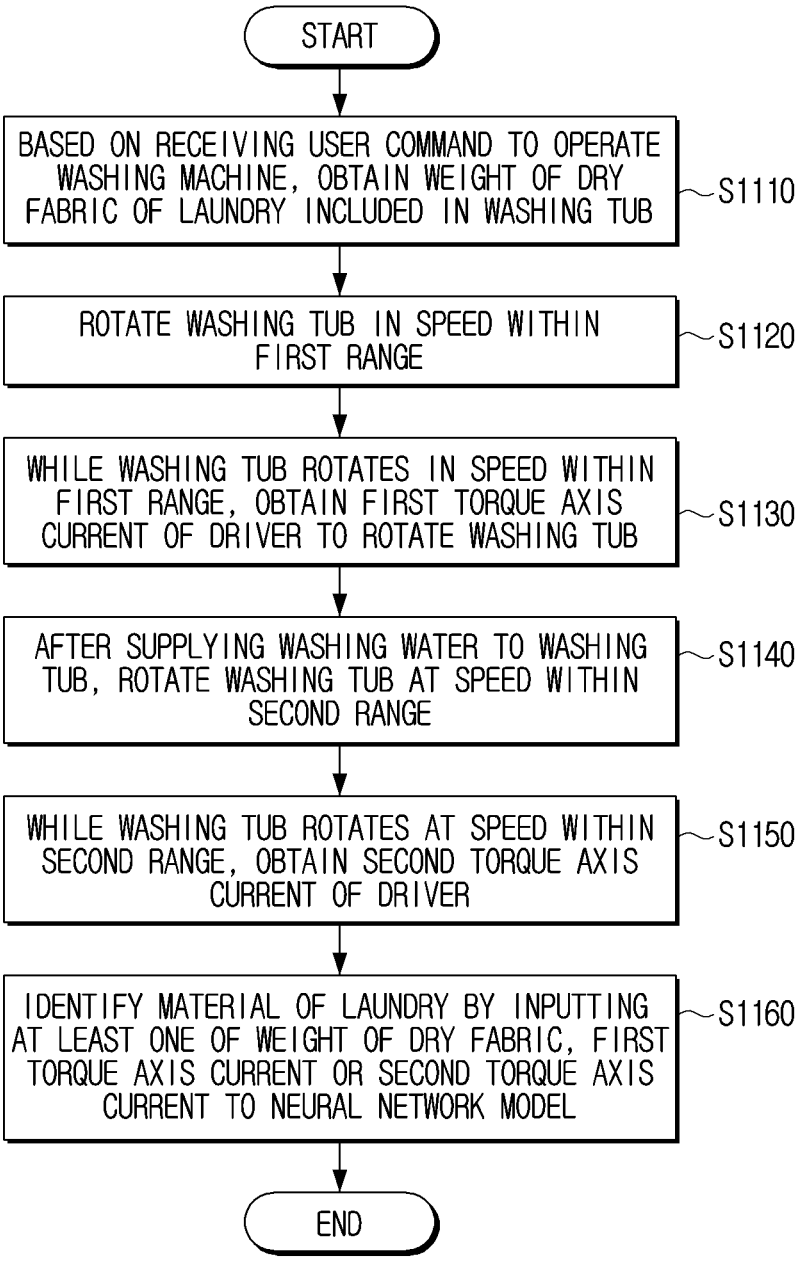
FIG. 11 is a flowchart illustrating a control method of a washing machine according to an embodiment of the disclosure.

FIG. 11 is a flowchart illustrating a control method of a washing machine according to an embodiment of the disclosure.

Referring to FIG. 11, a method of controlling a washing machine including a washing tub according to an embodiment may include, based on receiving a user command to operate the washing machine, obtaining a weight of dry fabric of the laundry included in the washing tub in operation S1110.

The method may include rotating the washing tub in a speed within a first range in operation S1120.

The method may include, while the washing tub rotates in a speed within the first range, obtaining a first torque axis current of a driver to rotate the washing tub in operation S1130.

The method may include, after supplying washing water to the washing tub, rotating the washing tub at a speed within a second range in operation S1140.

The method may include, while the washing tub rotates at a speed within the second range, obtaining a second torque axis current of the driver in operation S1150.

The method may include identifying a material of the laundry by inputting at least one of the weight of the dry fabric, the first torque axis current or the second torque axis current to a neural network model in operation S1160.

The first torque axis current may include a first average current value and a first standard deviation, the second torque axis current may obtain a second average current value and a second standard deviation, and the identifying the material in operation S1160 may include identifying the material by inputting weight of the dry fabric, the first average current value, the first standard deviation, the second average current value, and the second standard deviation to the neural network model.

The washing machine according to an embodiment may include washing course information corresponding to a plurality of materials, respectively, and the control method may further include obtaining washing course information corresponding to the identified material among plurality of washing course information and performing a washing course based on the obtained washing course information.

The washing course may include at least one of a washing operation, a rinsing operation, or a dehydration operation, and the performing of the washing course may include controlling an operation time of at least one of the washing operation, the rinsing operation, or the dehydration operation based on washing course information corresponding to the identified material and controlling a rotational speed during rotation of the washing tub according to at least one of the washing operation, rinsing operation, or dehydration operation.

The method according to an embodiment may include, based on a first average current value included in the first torque axis current being greater than or equal to a first threshold value, obtaining first washing course information corresponding to a first material identified by the neural network model and performing a washing course based on the first washing course information, and an operation time of the washing course according to the first washing course information may be shorter than an operation time of a normal washing course, or a rotational speed of the washing tub according to the first washing course information may be slower than a rotational speed of the washing tub according to the normal washing course.

The method may further include, based on a second standard deviation included in the second torque axis current being greater than or equal to a second threshold value, obtaining first washing course information corresponding to a first material identified by the neural network model and performing a washing course based on the first washing course information, and an operation time of the washing course according to the first washing course information may be shorter than an operation time of a normal washing course, or a rotational speed of the washing tub according to the first washing course information may be slower than a rotational speed of the washing tub according to the normal washing course.

The method may further include, based on a second average current value included in the second torque axis current being greater than or equal to a third threshold value, obtaining second washing course information corresponding to a second material identified by the neural network model and performing a washing course based on the second washing course information, and an operation time of the washing course according to the second washing course information may be longer than an operation time of a normal washing course, or a rotational speed of the washing tub according to the second washing course may be faster than the rotational speed of the washing tub according to the normal washing course.

The method according to an embodiment may include, based on a first average current value included in the first torque axis current being less than a first threshold value and a second average current value included in the second torque axis current being less than a third threshold value, obtaining third washing course information corresponding to a third material identified by the neural network model and performing a washing course based on the third washing course information, and an operation time of the washing course according to the third washing course information may correspond to an operation time of a normal washing course, and a rotational speed of the washing tub according to the third washing course information may correspond to a rotational speed of the washing tub according to the normal washing course.

The neural network model according to an embodiment may be a model trained to identify a material of the laundry using the weight of the dry fabric of the laundry, an average current value of the torque axis current according to the rotation of the washing tub, and the standard deviation.

Figure 12:
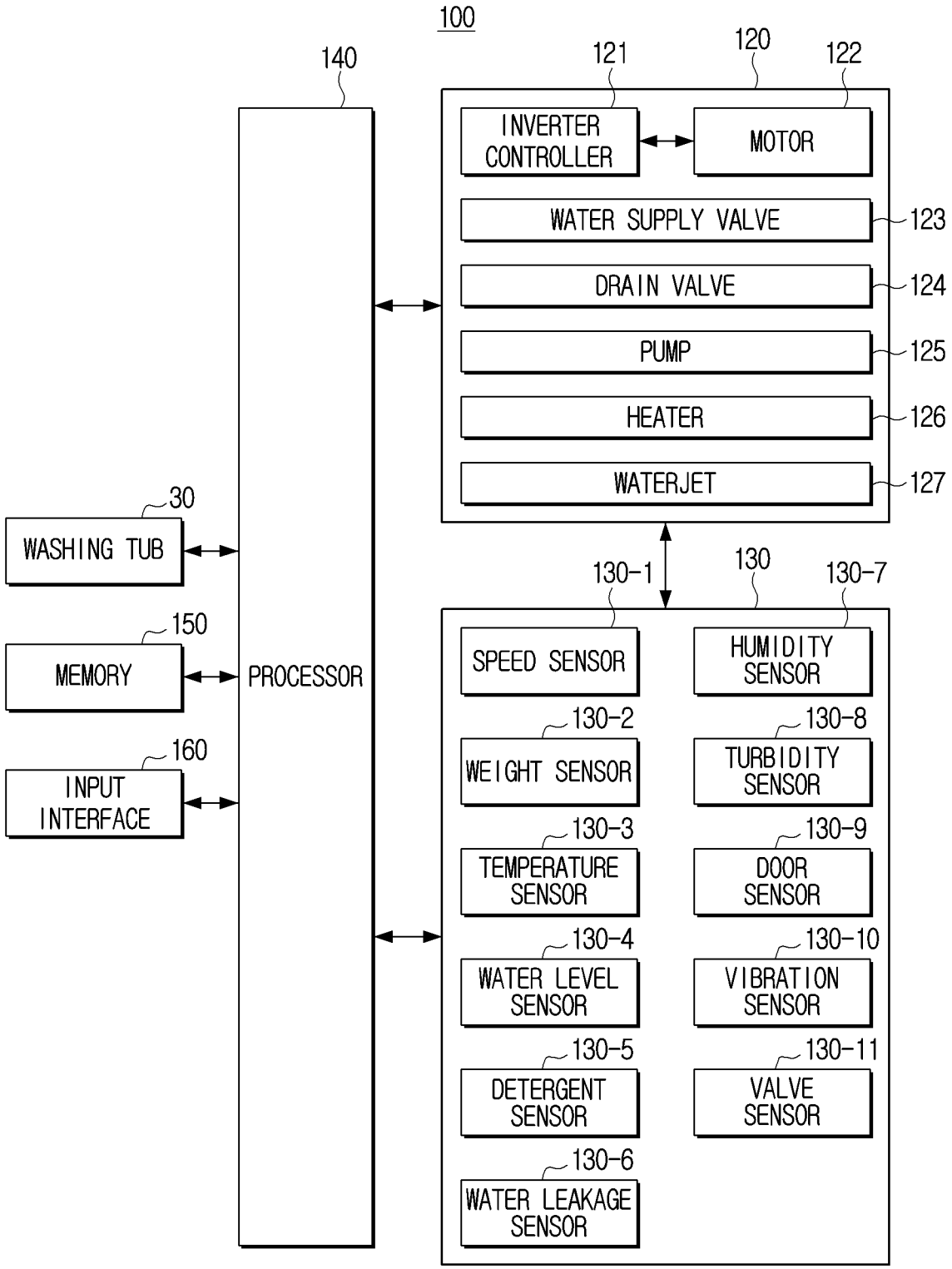
FIG. 12 is a block diagram illustrating a configuration of a washing machine in detail according to an embodiment of the disclosure.

FIG. 12 is a block diagram illustrating a configuration of a washing machine in detail according to an embodiment of the disclosure.

Referring to FIG. 12, the washing machine 100 may include the washing tub 30, the driver 120, the sensor 130, the processor 140, a memory 150, a display (not shown), a communication interface (not shown), an input interface 160, and a speaker (not shown). The description overlapping with the block diagram of FIG. 2 will not be further described to avoid redundancy.

The driver 120 is configured to perform an overall mechanical operation of the washing machine 100 and may perform an operation according to control of the processor 140. The driver 120 may rotate the washing tub 30 of the washing machine 100. The driver 120 may include an inverter controller 121 and a motor 122 as illustrated in FIG. 12.

The inverter controller 121 may refer to a device capable of driving the motor 122 by controlling a speed and torque of the motor 122. The inverter controller may control the speed of the motor 122 according to the control signal of the processor 140, and the inverter controller 121 may control the speed of the motor 122 using a voltage control method, a frequency conversion method, or the like.

The motor 122 may rotate the washing tub 30. The motor 122 may refer to a prime mover that converts externally applied energy (e.g., power, and the like) into power energy. The motor 122 may include a stator (not shown) and a rotor (not shown). The stator may be provided with a plurality of wound coils and internal resistors. The rotor may include a plurality of magnets for generating electromagnetic interaction with the coil. The rotor may rotate by electromagnetic interaction of the coil and the magnet.

The motor 122 may transmit the converted power energy to a rotary shaft (not shown). The rotary shaft may be coupled to the motor 122 and the washing tub 30 to transmit the power transmitted from the motor 122 to the washing tub 30 to rotate the washing tub 30. The rotary shaft may include a shaft, a bearing, and the like. Embodiments are not limited thereto, and the structure of the motor 122, the rotary shaft, and the washing tub 30 may be variously modified according to the structure of the washing machine 100.

For example, if the washing machine 100 is a drum type, the motor 122 may transmit power to the washing tub 30 through the rotary shaft. Here, the rotary shaft may be coupled to one side of the washing tub 30, and the power according to the driving of the motor 122 may be transmitted to the washing tub 30 to rotate the washing tub 30. In another embodiment, when the washing machine 100 is a pulsator type, the washing tub 30 may include a pulsator (not shown) installed on the bottom surface of the washing tub 30 and coupled to the rotary shaft, and the motor 122 may transmit power to the pulsator through the rotary shaft to rotate the pulsator.

The driver 120 according to an embodiment may rotate the washing tub 30, and may further rotate the washing tub 30 and the pulsator at the same time. The driver 120 may further include a clutch (not shown) for transmitting power according to the driving of the motor 122 to at least one of the washing tub 30 and the pulsator. In this example, the motor 122 may be mechanically connected through a clutch and a belt (not shown) to transmit power to the clutch, and the clutch may be coupled to the rotary shaft. For example, the clutch may transmit power to all or a part of the first rotary shaft coupled to the washing tub 30 included in the rotary shaft and the second rotary shaft coupled to the pulsator.

The motor 122 may further include a hall sensor (not shown). For example, the hall sensor may be installed at a specific position of the motor 122 or at respective specific angle intervals, and the hall sensor may output the position information of the rotor as an on or off signal according to the rotation of the rotor, and may detect the rotation direction, the rotational speed ($\omega$), and the rotation angle ($\theta$) based on the signal of the rotor.

Referring again to FIG. 12, the driver 120 according to an embodiment may further include at least one of a water supply valve 123, a drain valve 124, a pump 125, a heater 126, and a water jet 127.

The water supply valve 123 may be opened or closed so that the washing water may be supplied to the inside of the washing tub 30 or blocked by the control of the processor 140. The water supply valve 123 may be implemented as a solenoid valve, solenoid electromagnet valve, or the like, that may be opened or closed by a motion of a coil according to the applied current.

For example, the water supply valve 123 may be installed between an external water supply pipe (not shown) and a water supply pipe (not shown) of the washing machine 100. Here, the water supply pipe of the washing machine 100 may connect the external water supply pipe and the washing tub 30, and when the water supply valve 123 is in a power on state, the washing water may be supplied to the inside of the washing tub 30 along the water supply pipe. The water supply valve 123 may control the water supply to supply or block the washing water from the external water supply pipe to the washing tub 30 according to the state (on or off) of the water supply valve 123.

The water supply pipe may include a first water supply pipe connecting the external water supply pipe and a detergent supplier and a second water supply pipe connecting the detergent supplier and the washing tub 30, and as the washing water supplied from the external water supply pipe may pass through the detergent supplier, the washing water supply pipe 30 may supply the detergent filled in the detergent supplier to the inside of the washing tub 30 along with the washing water.

The external water supply pipe may include a hot water supply pipe and a cold water supply pipe for providing washing water that is divided into hot water and cold water according to the temperature. In this example, the water supply valve 123 may be independently controlled to supply or block washing water to the inside of the washing tub 30 according to the state (on or off) of the water supply valve 123 for each of the hot water supply pipe and the cold water supply pipe. As described above, the water supply valve 123 may adjust the amount or ratio of hot water and cold water supplied to the inside of the washing tub 30, and may adjust the temperature of the washing water filled in the washing tub 30.

The drain valve 124 may be opened or closed so that the washing water filled inside of the washing tub 30 to be drained or maintained by the control of the processor 140. The drain valve 124 may be implemented as a solenoid valve, solenoid electromagnet valve, or the like, that may be opened or closed by a motion of a coil according to the applied current.

For example, the drain valve 124 may be installed between a drain pipe and an external drain pipe of the washing machine 100. The drain pipe of the washing machine 100 may connect the washing tub 30 and the external drain pipe, and when the drain valve 124 is in the power on state, the washing water filled in the washing tub 30 may be drained to the external drain pipe along the drain pipe. The drain valve 124 may control so that the washing water is drained from the inside of the washing tub 30 to the outside or maintained according to the state (on or off) of the drain valve 124.

The pump 125 may discharge the washing water filled in the washing tub 30 to an external drain pipe using power or pressure under the control of the processor 140. The pump 125 may be installed between the drain pipe and the external drain pipe. The pump 125 may include a shaft (not shown) having an impeller (not shown), an electric motor (not shown) mechanically connected to the shaft, a suction pipe (not shown) connected to the drain pipe, and a discharge pipe connected to the external drain pipe. When the impeller rotates by the electric motor of the pump 125 when the drain valve 124 is turned on, the washing water in the washing tub 30 may pass through the suction pipe and the discharge pipe and may be forcibly discharged to the external drain pipe.

The pump 125 may vary the amount of circulating water (or washing water) in the washing tub 30 by varying the rotation revolutions per minute (RPM) of the impeller, and the pump 125 may vary the amount of bubbles in the washing tub 30. The pump 125 may include a circulation pump, a bubble pump, or the like. Various embodiments that vary the amount of circulating water or the amount of bubbles in the washing tub 30 by varying the rotation RPM of the impeller will be described later with reference to the flowchart of FIG. 13.

When power is applied according to the control of the processor 140, the heater 126 may convert the applied electric energy into thermal energy and may transmit the converted energy to the washing tub 30. The heater 126 may be installed inside the washing tub 30. For example, the heater 126 may heat the washing water filled in the washing tub 30, and may heat the laundry to wash inside the washing tub 30. The heater 126 may also heat the washing tub 30 to dry laundry inside the washing tub 30.

The water jet 127 may include a water jet pump (not shown) and a nozzle (not shown), and may use a water jet pump to spray the introduced washing water at a high pressure through a nozzle, and may spray the washing water to a specific position inside the washing tub 30 to remove contaminants remaining inside the washing tub 30. In this example, the water jet 127 may be implemented as a device separate from the spray nozzle for supplying washing water to the inside of the washing tub 30, or the water jet 127 may be implemented as one device integrated with the spray nozzle.

The sensor 130 may detect an operating state, a surrounding environment, or the like, of the washing machine 100, and may generate and output an electric signal for the detection result. The sensor 130 may transmit the electric signal to the processor 140, or may store the detection result in the memory 150 of the washing machine 100 or an external device.

The sensor 130 may detect an operation state or a surrounding environment of the washing machine 100 while the washing course is performed, and may obtain diagnostic information for the washing machine 100. The sensor 130 may merely detect an operation state or a surrounding environment of the washing machine 100 to obtain diagnostic information, thereby generating or obtaining an electrical signal as a result of detecting, and the processor 140 may process signal or data received from the sensor 130 to obtain diagnostic information.

The diagnosis information may include at least one of the weight of the washing tub 30, whether there is an abnormality in the water supply valve 123 to supply washing water to, for example, a spit basket, the temperature of the washing water supplied to the spit basket, the flow rate of the washing water supplied to the spit basket, whether there is an abnormality in the motor 122, whether there is an abnormality in the drain valve 124 to drain washing water, the flow rate of the washing water drained from the washing tub 30, or information on the vibration of the washing machine 100.

The sensor 130 may include at least one of a speed sensor 130-1, a weight sensor 130-2, a temperature sensor 130-3, a water level sensor 130-4, a detergent sensor 130-5, a leakage sensor 130-6, a humidity sensor 130-7, a turbidity sensor 130-8, a door sensor 130-9, a vibration sensor 130-10, and a valve sensor 130-11. Respective sensors included in the sensor 130 may be implemented as physically separate devices or respective sensors may be implemented as a single device. The sensor 130 is not limited to a case where one physical device is implemented.

The speed sensor 130-1 may detect a rotation speed (ω), a rotation angle (θ), a rotation direction, or the like, of the motor 122 and/or the washing tub 30. In this example, the processor 140 may store the rotation speed (ω), the rotation angle (θ), the rotation direction of the motor 122 or the washing tub 30 detected by the speed sensor 130-1 as diagnostic information in the memory 150, or may transmit the information to an external device (e.g., a server, a smartphone, and the like) through the communication interface to be stored in an external device. When the motor 122 rotates the washing tub 30, the speed sensor 130-1 may be implemented as a sensor using a method of detecting the magnitude of the load applied to the motor 122, a method of detecting an on/off signal of the hall sensor adjacent to the position of the rotor while the rotor of the motor 122 rotates, and a method for measuring the magnitude of the current applied to the driver 120 or the motor 122 during rotation of the washing tub 30. Embodiments are not limited thereto, and may be implemented with various types of sensors.

The weight sensor 130-2 may sense the weight of the washing tub 30. In this example, the processor 140 may store the weight of the washing tub 30 sensed by the weight sensor 130-2 as diagnostic information in the memory 150, or may transmit the weight of the washing tub 30 to an external device (e.g., a server, a smartphone, and the like) through the communication interface to be stored in an external device. The weight sensor 130-2 may sense the weight of the laundry. For example, when the laundry is present in the washing tub 30, the weight sensor 130-2 may sense the weight of the laundry and may estimate a difference between the sensed weight and the prestored weight of the washing tub 30 as the weight of the laundry.

According to an embodiment, the weight sensor 130-2 may rotate the washing tub 30 in which no laundry is present, and detect the weight of the washing tub 30 to obtain the sensed weight as diagnostic information. For this, the weight sensor 130-2 may detect the weight of the washing tub 30 by estimating a moment of inertia from the rotation speed (ω) and rotation angle (θ) of the washing tub 30 or the motor 122 detected through the speed sensor 130-1 and estimating a weight corresponding to the moment of inertia, or the like.

As another embodiment, the weight sensor 130-2 may be implemented as various sensors that may estimate the weight of the washing tub 30 corresponding to the magnitude of voltage by changing a load cell if the weight of the washing tub 30 is added to the load cell and detect the magnitude of voltage according to a changed form, or the like.

The temperature sensor 130-3 may detect the temperature (e.g., room temperature) of the surrounding environment of the washing machine 100 or the temperature of the washing water. In this example, the processor 140 may store the temperature of the ambient environment of the washing machine 100 sensed by the temperature sensor 130-3 or the temperature of the washing water in the memory 150 as diagnostic information, or may transmit the temperature to an external device (e.g., a server, a smartphone, and the like) through the communication interface to be stored in an external device. The temperature sensor 130-3 may be implemented as a thermistor, which is a kind of a resistor using a property of changing the resistance of the material according to the temperature, and the thermistor may have a negative temperature coefficient (NTC) feature that the resistance decreases when the temperature rises, and when the temperature is lowered, the resistance is increased.

The temperature sensor 130-3 may further include a temperature adjustment device (e.g., thermostat). The temperature adjustment device may detect a heat emission amount generated by the heater 126 and may control to maintain the temperature of the washing water or the washing tub 30 to a predetermined temperature by the heat generated by the heater 126.

The water level sensor 130-4 may sense the water level or the flow rate of the washing water. The processor 140 may store the water level or flow rate of the washing water sensed by the water level sensor 130-4 in the memory 150 as diagnostic information, or may transmit the water level or flow rate to an external device (e.g., a server, a smartphone, and the like) through the communication interface to be stored in an external device. Specifically, the water level sensor 130-4 may detect the water level or flow rate of the washing water while the washing water is supplied into the washing tub 30 or the washing water is drained inside the washing tub 30. The water level sensor 130-4 may be implemented as a mechanical water level detection sensor, a pressure-sensitive sensor, a sensor using a semiconductor or capacitance, or the like.

The water level sensor 130-4 may obtain the flow rate of the washing water supplied to the washing tub 30 or the flow rate of the washing water drained from the washing tub 30 as diagnostic information of the washing machine 100. The flow rate of the washing water supplied to the washing tub 30 may include a water supply amount, a water supply amount per hour having a unit such l/min (litter/minute; LPM), l/s (litter/second; LPS), and the flow rate of the washing water drained from the washing tub 30 may include a drainage amount, and a drainage amount per hour.

The flow rate of the washing water supplied to the washing tub 30 and the flow rate of the washing water drained from the washing tub 30 may be used to determine the water supply time and the drainage time. For example, the amount (l) of the washing water to be supplied to the washing tub 30 may be divided by a water supply amount (l/min) per hour to determine a water supply time (min) at which washing water is supplied. The history of the flow rate of the washing water supplied to the washing tub 30 or the flow rate of washing water drained from the washing tub 30 may be used to provide notification information to the user. For example, by comparing the history of the flow rate of the washing water supplied to the washing tub 30 and the flow rate of the washing water drained from the washing tub 30, notification information notifying that a check or a replacement of the supply pipe and drainage pipe is necessary, if the water supply amount per hour (l/min) decreases to a preset value (e.g., 2 l/min) or below, and provide the user with the information.

The detergent sensor 130-5 may sense a residual amount or type of detergent (or rinsing agent). For example, the detergent sensor 130-5 may be composed of a plurality of electrodes, and may detect the residual amount of detergent or the type of detergent through a resistance value between the plurality of electrodes, and may be divided into a plurality of spaces to be installed in a detergent supply unit in which a detergent and a rinsing agent may be injected. The detergent sensor may be implemented as a water level sensor, a turbidity sensor, or a combination thereof.

The leakage sensor 130-6 may detect the leakage of the washing water. In this example, the processor 140 may store the leakage of the washing water sensed by the leakage sensor 130-6 in the memory 150 as diagnostic information, or may transmit the leakage of water to an external device (e.g., a server, a smartphone, and the like) through the communication interface to store the same in an external device. For example, a water storage unit formed in a cabinet may store washing water leaked from the washing tub 30, and the leakage sensor 130-6 may detect the water level of the washing water filled in the water storage unit and detect the leakage of the washing water when the water level is greater than or equal to a predetermined value. The leakage sensor 130-6 may be implemented as a float switch.

The humidity sensor 130-7 may sense the amount of moisture (water vapor) in the air. For example, the humidity sensor 130-7 may be implemented in an electrical resistance or capacitive manner. Specifically, the electrical resistance type humidity sensor may detect a change in the electric resistance of a material of which the electrical resistance changes, when moisture is absorbed, and the electrical capacitive type humidity sensor may be filled with a dielectric material of which dielectric constant changes according to humidity between the capacitors, thereby detecting the electric capacity of both ends of the electrode to detect humidity.

The turbidity sensor 130-8 may sense the turbidity (degree of inclusion of foreign substances) of a liquid. More specifically, the turbidity sensor 130-8 may detect the turbidity of the washing water used in the washing process and rinsing process, or the like, of the washing machine 100. The turbidity sensor 130-8 may include a light emitter (not shown) and a light receiver (not shown). For example, the light emitter may emit light, and the light receiver may receive the light. When the light irradiated from the light emitter passes through washing water and is received at the light receiver, turbidity may be detected from the difference of amount of received light. The turbidity may be used to determine the washing time of the laundry, the soaking time of the laundry, the number of rinsing times of the laundry, an injection amount of the detergent, or the like.

The door sensor 130-9 may sense whether the door 12 is opened or closed. For example, the door sensor 130-9 may sense whether the door 12 is opened or closed by sensing the electric potential, the intensity of the current, or the strength of the magnetic field depending on whether a portion of the door 12 (e.g., a lever that may be coupled to the cabinet) is in contact with the cabinet. The door sensor 130-9 may be implemented as a reed switch, a checker switch, or the like.

The vibration sensor 130-10 may detect a degree of vibrating of the washing machine 100. The vibration sensor 130-10 may detect a degree of vibrating of the washing machine 100 by the rotational operation of the washing tub 30 while the washing tub 30 is rotating, in the washing and dehydration operations, or the like. The vibration sensor 130-10 may be implemented as micro-electro mechanical systems (MEMS), or the like.

The valve sensor 130-11 may sense whether the operation of the water supply valve 123 or the drain valve 124 is normal or abnormal. The processor 140 may store any abnormality of the operation of the water supply valve 123 or the drain valve 124 sensed by the valve sensor 130-11 in the memory 150 as diagnostic information, or may transmit the information to an external device (e.g., a server, a smartphone, and the like) through the communication interface to be stored in an external device. For example, the valve sensor 130-11 may detect a degree of opening (opening level) of the water supply valve 123 or the drain valve 124, when the water supply valve 123 or the drain valve 124 is turned on, and may detect that, if the opening degree is less than a preset value, the water supply valve 123 or the drain valve 124 may have an abnormality. When the water supply valve 123 or the drain valve 124 is in the off state, the valve sensor 130-11 may sense a degree of opening of the water supply valve 123 or the drain valve 124 and may sense that the water supply valve 123 or the drain valve 124 has abnormality in operation if the opening degree is greater than or equal to a predetermined value. The processor 140 may obtain the abnormality of the operation of the water supply valve 123 or the drain valve 124 through the valve sensor 130-11 as diagnostic information, and the processor 140 may generate notification information notifying that there is an abnormality in the operation of the water supply valve 123 or the drain valve 124 and provide the notification information to the user. The valve sensor 130-11 may be implemented with various types of sensors depending on the structure of the water supply valve 123 or the drain valve 124.

The processor 140 according to an embodiment may identify a material of the laundry and may perform a washing course based on the washing course information corresponding to the identified material.

The processor 140 may also change the operation time of the washing process, rinsing process, and dehydration process, respectively, according to the identified material, and may change the rotational speed, or the like, of the driver 120 between the respective operations.

The processor 140 may also control the operation of the pump 125 according to the identified material. For example, the processor 140 may change the rotation RPM of the impeller by controlling the pump 125 according to the identified material.

For example, if the identified material is a delicate cloth, the processor 140 may control the pump 125 to increase the amount of bubbles to alleviate the impact during the falling of the laundry according to the rotation of the washing tub 30. Accordingly, the laundry may be prevented from being damaged during the washing course, and detergent components may be effectively transferred to the laundry to wash the delicate cloth.

As another example, the processor 140 may control the pump 125 to increase the amount of circulating water in the washing tub 30 if the identified material is general clothing. Accordingly, the detergent may be effectively delivered to the laundry during the course of the washing to wash the general clothes. However, this is merely example and is not limited thereto. As another example, the processor 140 may control the pump 125 to increase the amount of circulating water and reduce the amount of bubbles when the identified material is towels.

The processor 140 according to an embodiment may also control the operation of the pump 125 based on the level of contamination of laundry, in addition to the material of laundry.

For example, if the level of contamination of the laundry is greater than or equal to a threshold level, the processor 140 may control the pump 125 so that both the amount of bubbles and circulating water may increase.

As another example, if the level of contamination of laundry is less than a threshold level, the processor 140 may control the pump 125 so that both the amount of bubbles and circulating water may decrease.

The processor 140 may also sense the contamination of the laundry through the sensor 130 provided in the washing machine 100, or may be obtained based on a user input. For example, after the laundry is introduced into the washing tub 30, when a user input for selecting any one of a high degree of contamination, an average contamination level, and a low contamination level is received, the contamination level of the laundry may be identified based on the user input, and the operation of the pump 125 may be controlled according to the identified degree of contamination.

If the contamination level of laundry is high, both the amounts of bubbles and circulating water may increase so as to efficiently deliver the detergent to the laundry. As another example, if the contamination level of the laundry is low, both the amounts of bubbles and circulating water may be reduced so as to increase energy efficiency.

According to an embodiment, the processor 140 may also control an operation of the pump 125 based on the residual amount or type of the detergent, in addition to the material of the laundry and the contamination level of the laundry.

For example, the processor 140 may reduce the rotational RPM of the pump 125 if the type of detergent sensed by the detergent sensor 130-5 is a liquid detergent. As another example, the processor 140 may increase the rotational RPM of the pump 125 if the type of detergent sensed by the detergent sensor 130-5 is a solid (e.g., powder) detergent.

The liquid detergent may have a low antifoaming agent and a high surfactant and accordingly, generation of bubbles may be relatively easier than with the solid detergent, so even if the pump 125 reduces the rotation RPM of the impeller, the detergent substance may be efficiently delivered to the laundry, and energy efficiency may be improved.

This is merely an example, and is not limited thereto. For example, the processor 140 may increase the rotation RPM of the pump 125 to increase amounts of bubbles and circulating water, even though the type of detergent is liquid.

As another example, the processor 140 may control the operation of the pump 125 in consideration of all of the contamination level of the laundry, material of the laundry, and type of the laundry.

Figure 13:
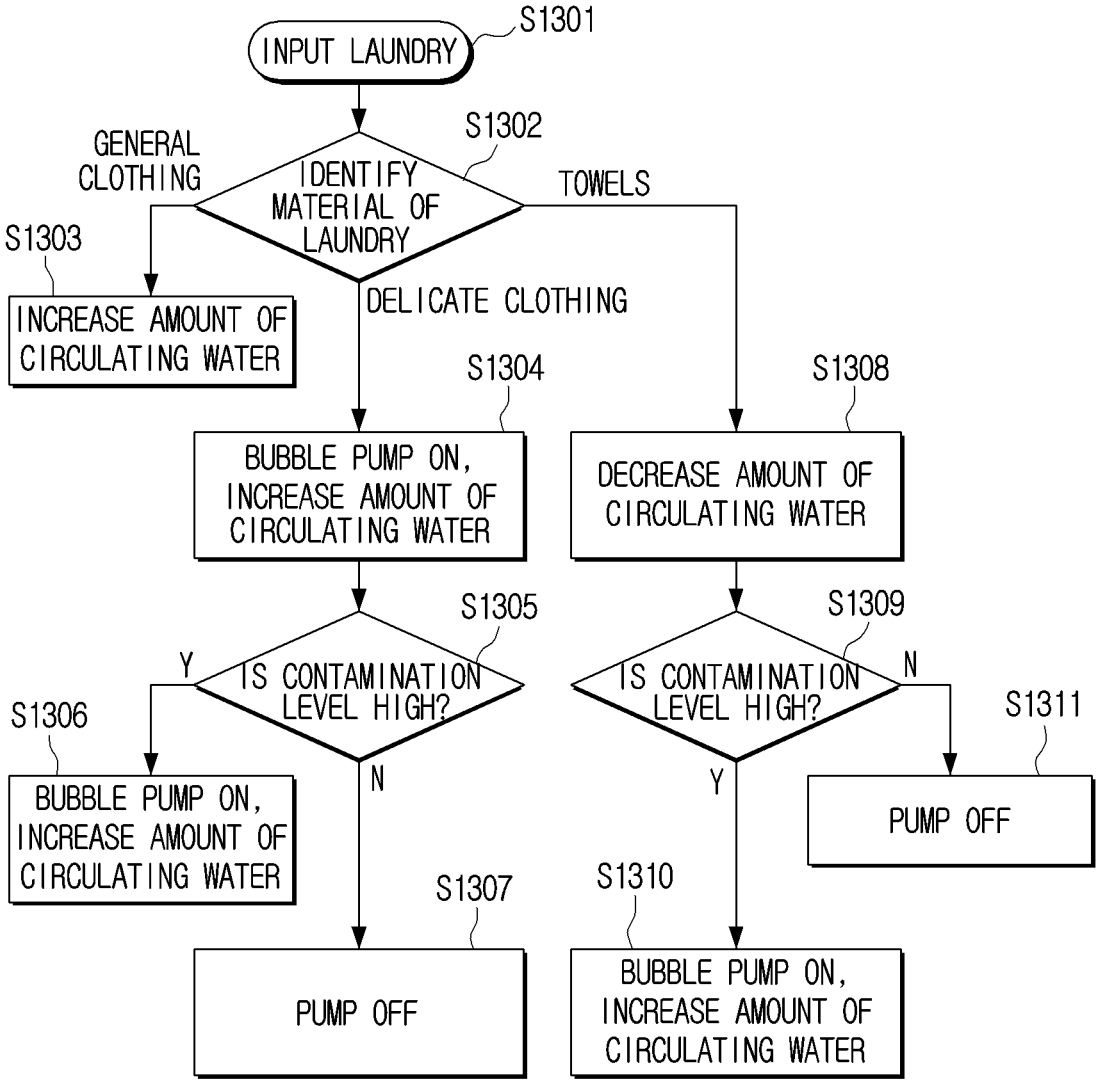
FIG. 13 is a flowchart illustrating an operation of a washing machine according to an embodiment of the disclosure.

FIG. 13 is a flowchart illustrating an operation of a washing machine according to an embodiment of the disclosure.

Referring to FIG. 13, if the laundry is input to the washing tub 30 of the washing machine 100 in operation S1301, the washing machine 100 may identify a material of the laundry in operation S1302.

If the material of laundry is a general clothing, the washing machine 100 may control the pump 125 to increase the amount of circulating water in operation S1303.

As another example, if the material of the laundry is delicate clothing, the washing machine 100 may turn on the bubble pump and may increase the amount of circulating water in operation S1304. The operation of turning on the bubble pump may refer to controlling the pump 125 to generate bubbles in the washing tub 30.

If the contamination level of the laundry is high by identifying the contamination level of the laundry in operation S1305-Y, the washing machine 100 may control the pump 125 to generate bubbles and increase the amount of circulating water in operation S1306.

If contamination level of laundry is low in operation S1305-N, the washing machine 100 may turn off the pump 125 in operation S1307.

If the material of laundry is towels, the washing machine 100 may decrease an amount of circulating water in operation S1308. As absorption rate of towels is high, liquid detergent may be efficiently delivered to laundry with little circulating water.

After identifying the level of contamination of laundry, if the level of contamination is high in operation S1309 (Y), the washing machine 100 may control the pump 125 to generate bubbles and increase an amount of circulating water in operation S1310. If the contamination level of laundry is low in operation S1309 (N), the washing machine 100 may turn off the pump 125 in operation S1311. When the contamination level is low, the washing machine 100 may turn off the pump 125 and increase the energy efficiency.

Various embodiments of this disclosure may be applicable not only to a washing machine, but also to all electronic devices capable of obtaining a sensing value by including a sensor.

The various embodiments described above may be implemented in a recordable medium which is readable by a computer or a device similar to a computer using software, hardware, or a combination of software and hardware. In some cases, embodiments described herein may be implemented by a processor itself. According to a software implementation, embodiments such as the procedures and functions described herein may be implemented with separate software modules. Each of the software modules may perform one or more of the functions and operations described herein.

According to various embodiments described above, computer instructions for performing processing operations of a device according to the various embodiments described above may be stored in a non-transitory, computer-readable medium. The computer instructions stored in the non-transitory, computer-readable medium may cause a particular device to perform processing operations on the device according to the various embodiments described above when executed by the processor of the particular device.

The non-transitory, computer-readable medium does not refer to a medium that stores data for a short period of time, such as a register, cache, memory, and the like, but semi-permanently stores data and is available for reading by the device. For example, the non-transitory, computer-readable medium may be a CD, DVD, hard disc, Blu-ray disc, USB, memory card, ROM, or the like.

While the disclosure has been shown and described with reference to various embodiments thereof, it will be understood by those skilled in the art that various changes in form and detail may be made therein without departing from the spirit and scope of the disclosure as defined by the appended claims and their equivalents.

What is claimed is:

1. A washing machine comprising:

a washing tub;

a driver configured to rotate the washing tub;

memory, comprising one or more storage media, storing instructions;

a sensor configured to sense an operation of the washing machine; and at least one processor communicatively coupled to the driver, the memory, and the sensor, wherein the instructions, when individually or collectively executed by the at least one processor, cause the washing machine to:

based on receiving a user command to operate the washing machine, obtain from the sensor, a weight of dry fabric of laundry in the washing tub, control the driver to rotate the washing tub at a speed within a first range, while the washing tub rotates at the speed within the first range, obtain a first torque axis current of the driver sensed through the sensor, the first torque axis current comprising a first average current value and a first standard deviation, after supplying washing water to the washing tub, control the driver to rotate the washing tub at a speed within a second range, while the washing tub rotates at the speed within the second range, obtain a second torque axis current of the driver sensed through the sensor, and identify a material of the laundry based, in part, on inputting the weight of the dry fabric, the first torque axis current, and the second torque axis current to a neural network model.

2. The washing machine of claim 1, wherein the second torque axis current comprises a second average current value and a second standard deviation, and wherein the material is identified based, at least in part, on inputting the weight of the dry fabric, the first average current value, the first standard deviation, the second average current value, and the second standard deviation to the neural network model.

3. The washing machine of claim 1, further comprising:

wherein the memory is further configured to store a plurality of washing course information corresponding to a plurality of materials, respectively, and wherein the instructions, when individually or collectively executed by the at least one processor, further cause the washing machine to:

obtain washing course information corresponding to the identified material among the plurality of washing course information stored in the memory, and perform a washing course based on the obtained washing course information.

4. The washing machine of claim 3, wherein the washing course comprises at least one of a washing operation, a rinsing operation, or a dehydration operation, and wherein the instructions, when individually or collectively executed by the at least one processor, further cause the washing machine to:

control an operation time of at least one of the washing operation, the rinsing operation, or the dehydration operation based on the washing course information corresponding to the identified material, and control a rotational speed during rotation of the washing tub according to at least one of the washing operation, the rinsing operation, or the dehydration operation.

5. The washing machine of claim 1, wherein the instructions, when individually or collectively executed by the at least one processor, further cause the washing machine to:

based on the first average current value included in the first torque axis current being greater than or equal to a first threshold value, obtain first washing course information corresponding to a first material identified by the neural network model, and perform a washing course based on the first washing course information, wherein an operation time of the washing course according to the first washing course information is shorter than the operation time of a normal washing course, or wherein a rotational speed of the washing tub according to the first washing course information is slower than the rotational speed of the washing tub according to the normal washing course.

6. The washing machine of claim 1, wherein the instructions, when individually or collectively executed by the at least one processor, further cause the washing machine to:

based on a second standard deviation included in the second torque axis current being greater than or equal to a second threshold value, obtain first washing course information corresponding to a first material identified by the neural network model, and perform a washing course based on the first washing course information, wherein an operation time of the washing course according to the first washing course information is shorter than the operation time of a normal washing course, or wherein a rotational speed of the washing tub according to the first washing course information is slower than the rotational speed of the washing tub according to the normal washing course.

7. The washing machine of claim 1, wherein the instructions, when individually or collectively executed by the at least one processor, further cause the washing machine to:

based on a second average current value included in the second torque axis current being greater than or equal to a third threshold value, obtain second washing course information corresponding to a second material identified by the neural network model, and perform a washing course based on the second washing course information, wherein an operation time of the washing course according to the second washing course information is longer than the operation time of a normal washing course, or wherein a rotational speed of the washing tub according to the second washing course is faster than the rotational speed of the washing tub according to the normal washing course.

8. The washing machine of claim 1, wherein the instructions, when individually or collectively executed by the at least one processor, further cause the washing machine to:

based on the first average current value included in the first torque axis current being less than a first threshold value and a second average current value included in the second torque axis current being less than a third threshold value, obtain third washing course information corresponding to a third material identified by the neural network model, and perform a washing course based on the third washing course information, wherein an operation time of the washing course according to the third washing course information corresponds to the operation time of a normal washing course, and wherein a rotational speed of the washing tub according to the third washing course information corresponds to the rotational speed of the washing tub according to the normal washing course.

9. The washing machine of claim 1, wherein the instructions, when individually or collectively executed by the at least one processor, further cause the washing machine to train the neural network model to identify the material of the laundry using a weight of a dry fabric of laundry, an average current value of a torque axis current according to the rotating of the washing tub, and a standard deviation.

10. The washing machine of claim 1, wherein the instructions, when individually or collectively executed by the at least one processor, further cause the washing machine to, based on the weight of the dry fabric being less than a threshold weight, perform a washing course based on a normal washing course.

11. The washing machine of claim 1, wherein the speed within the first range is faster than the speed within the second range.

12. The washing machine of claim 1, further comprising:

a circulation pump and a bubble pump, wherein the instructions, when individually or collectively executed by the at least one processor, further cause the washing machine to:

control the circulation pump based on an amount of circulation water corresponding to the identified material of the laundry, or control the bubble pump based on an amount of bubbles corresponding to the identified material of the laundry.

13. The washing machine of claim 12, wherein the instructions, when individually or collectively executed by the at least one processor, further cause the washing machine to:

reduce a rotational speed of the circulation pump if a type of detergent used in the washing machine is a liquid detergent, and increase the rotational speed of the circulation pump if the type of detergent used in the washing machine is a solid detergent.

14. The washing machine of claim 12, wherein the instructions, when individually or collectively executed by the at least one processor, further cause the washing machine to:

reduce a rotational speed of the circulation pump if a level of contamination of the laundry is greater than or equal to a threshold level, and increase the rotational speed of the circulation pump if the level of contamination of the laundry is less than the threshold level.

* * * * *